US009661981B2

(12) United States Patent
Classen et al.

(10) Patent No.: US 9,661,981 B2
(45) **Date of Patent: *May 30, 2017**

(54) DISHWASHER COMPRISING A SORPTION DRYING SYSTEM

(75) Inventors: Egbert Classen, Stahnsdorf (DE); Helmut Jerg, Giengen (DE); Kai Paintner, Adelsried (DE)

(73) Assignee: BSH Hausgeräte GmbH, Munich (DE)

( * ) Notice: Subject to any disclaimer, the term of this patent is extended or adjusted under 35 U.S.C. 154(b) by 1199 days.

This patent is subject to a terminal disclaimer.

(21) Appl. No.: 13/055,486

(22) PCT Filed: Jul. 27, 2009

(86) PCT No.: PCT/EP2009/059686

§ 371 (c)(1),
(2), (4) Date: Jan. 24, 2011

(87) PCT Pub. No.: WO2010/012696

PCT Pub. Date: Feb. 4, 2010

(65) Prior Publication Data

US 2011/0114141 A1 May 19, 2011

(30) Foreign Application Priority Data

Jul. 28, 2008 (DE) ..... 10 2008 040 789
Aug. 27, 2008 (DE) ..... 10 2008 039 900
Nov. 7, 2008 (DE) ..... 10 2008 043 581

(51) Int. Cl.
*A47L 15/42* (2006.01)
*A47L 15/48* (2006.01)
*A47L 15/00* (2006.01)

(52) U.S. Cl.
CPC ..... *A47L 15/481* (2013.01); *A47L 15/0026* (2013.01); *A47L 15/0034* (2013.01);
(Continued)

(58) Field of Classification Search
CPC ..... A47L 15/0026; A47L 15/0034; A47L 15/481; A47L 2301/00; A47L 2501/04;
(Continued)

(56) References Cited

U.S. PATENT DOCUMENTS 4,106,517 A 8/1978 Wright
4,249,090 A 2/1981 Cushing
(Continued)

FOREIGN PATENT DOCUMENTS

DE 4244365 A1 7/1993
DE 10035642 C1 12/2001
(Continued)

OTHER PUBLICATIONS

Machine Translation of EP 0943282 to Vogel et al., Sep. 1999.*
Machine Translation WO 2006061293 to Jerg et al. Jun. 2006.*

*Primary Examiner* — Michael Barr
*Assistant Examiner* — Benjamin L Osterhout
(74) *Attorney, Agent, or Firm* — Michael E. Tschupp; Andre Pallapies

(57) ABSTRACT

A dishwasher having a washing container; a controller to control the operation of the dishwasher by means of a wash program; a desorption drying system to dry items to be washed that are arranged inside the washing container; and input means that are connected to the controller and that modify the wash program.

14 Claims, 12 Drawing Sheets

(52) U.S. Cl.
CPC ..... *A47L 2301/00* (2013.01); *A47L 2501/04* (2013.01); *A47L 2501/06* (2013.01); *A47L 2501/07* (2013.01); *A47L 2501/30* (2013.01)

(58) Field of Classification Search
CPC ..... A47L 2501/06; A47L 2501/07; A47L 2501/30
USPC ..... 134/56 D, 57 D, 58 D, 95.2, 102.3, 105
See application file for complete search history.

(56) References Cited

U.S. PATENT DOCUMENTS

| | | | | |
|---|---|---|---|---|
| 4,713,944 | A * | 12/1987 | Januschkowetz | 62/480 |
| 8,709,171 | B2 * | 4/2014 | Jerg | A47L 15/4251 134/56 D |
| 2003/0213503 | A1 * | 11/2003 | Price et al. | 134/18 |
| 2004/0144408 | A1 * | 7/2004 | Sakane et al. | 134/58 D |
| 2006/0096618 | A1 * | 5/2006 | Price et al. | 134/25.2 |
| 2006/0260656 | A1 | 11/2006 | Berner et al. | |
| 2006/0278257 | A1 * | 12/2006 | Jerg et al. | 134/56 D |
| 2007/0157954 | A1 * | 7/2007 | Classen et al. | 134/56 D |
| 2007/0295360 | A1 | 12/2007 | Jerg et al. | |
| 2007/0295373 | A1 | 12/2007 | Jerg et al. | |
| 2008/0083433 | A1 | 4/2008 | Jerg et al. | |
| 2008/0127997 | A1 | 6/2008 | Jerg et al. | |
| 2009/0159099 | A1 | 6/2009 | Fauth et al. | |

FOREIGN PATENT DOCUMENTS

| | | | |
|---|---|---|---|
| DE | 10353774 | A1 | 2/2005 |
| DE | 10353775 | A1 | 2/2005 |
| EP | 0777998 | A1 | 6/1997 |
| EP | 0943282 | A2 | 9/1999 |
| EP | 1132038 | A2 | 9/2001 |
| EP | 1865156 | A1 | 12/2007 |
| WO | WO 2006061293 | A1 * | 6/2006 |

* cited by examiner

DISHWASHER COMPRISING A SORPTION DRYING SYSTEM

BACKGROUND OF THE INVENTION

The present invention relates to a dishwasher, in particular a household dishwasher, comprising at least one washing container and at least one sorption drying system for drying items to be washed, the sorption drying system having at least one sorption container comprising a reversibly dehydratable sorption material, said container being connected to the washing container by means of at least one air-guiding channel for the generation of an air flow.

Dishwashers with a so-called sorption column for drying crockery are known for example from DE 103 53 774 A1, DE 103 53 775 A1 or DE 10 2005 004 096 A1. In the "drying" subprogram step of the respective dishwashing program of the dishwasher for drying crockery, moist air is guided by means of a fan out of the washing container of the dishwasher through the sorption column and moisture is removed from the air guided therethrough by the reversibly dehydratable drying material of said sorption column through condensation. For regeneration, i.e. desorption of the sorption column, the reversibly dehydratable drying material thereof is heated to very high temperatures. Water stored in this material is thereby released as hot water vapor and is guided by an air flow generated by means of the fan into the washing container. A washing liquor and/or items to be washed located in the washing container, as well as the air located in the washing container can be heated by this means.

A sorption column of this type has proven to be highly advantageous for the energy-saving and quiet drying of items to be washed. To avoid local overheating of the sorption drying material during the desorption process, in DE 10 2005 004 096 A1, for example, a heater is arranged in the direction of flow of the air, upstream of the air inlet of the sorption column. Despite this "air heating" during desorption, it remains difficult in practice to dry the reversibly dehydratable drying material consistently adequately and thoroughly.

BRIEF SUMMARY OF THE INVENTION

The object of the invention is to provide an improved dishwasher, in particular an improved household dishwasher, with a sorption drying system.

This object of the invention is achieved by a dishwasher having at least one washing container, a control device which is configured to control proper operation of the dishwasher by means of a washing program and at least one sorption drying system for drying items to be washed able to be arranged within the washing container, as well as input means connected to the control device for modifying the washing program. The inventive dishwasher is especially a household dishwasher.

Accordingly the inventive dishwasher comprises the washing container in which items to be washed, i.e. crockery, can be arranged and the control device which controls the proper operation of the inventive dishwasher, especially a washing program provided for cleaning the items to be washed. The inventive dishwasher further comprises a sorption drying system which is designed for drying the items to be washed, especially at the end of a washing program during a drying step for example. In addition the inventive dishwasher also includes the input means connected to the control device, by means of which an operator can modify the washing program for example. "Modifying the washing program" should be understood here as not only a modification of one or more subprogram steps which are executed during the washing program, but also selecting a washing program from a plurality of washing programs.

Because of the input means, which can for example be embodied as buttons or program buttons, the washing program can be changed and for example adapted in a relatively simple manner to the crockery in use or to the load state of the inventive dishwasher or also to the preferences of an operator of the inventive dishwasher. Accordingly a "sorption drying" program differentiation may be made possible by means of the input means.

In accordance with a variant of the inventive dishwasher, the sorption drying system comprises at least one sorption container with reversibly dehydratable sorption drying material, which is connected to the washing container by means of an air guiding channel for the passage of an air flow. The sorption container can for example be embodied with a geometrical shape such that a through-flow direction substantially in or against the direction of gravity is specified for its sorption unit with the sorption drying material. This ensures to a large extent that moist air, which in the respectively required drying process is guided by means of the air-guiding channel out of the washing container into the sorption container and flows through the sorption unit thereof comprising the sorption drying material can be dried in a thorough, reliable and energy-efficient manner through sorption by means of the sorption drying material. Later, after this drying process, e.g. in at least one rinsing or cleaning cycle of a later newly started dishwashing program, the sorption material can be regenerated through desorption, i.e. processed, again in a thorough, energy-efficient and material-saving manner in preparation for a subsequent drying process.

In particular the sorption container of this variant, because of its specific through-flow characteristic, can be embodied in an especially compact and space-saving manner and yet still accommodate the quantity of sorption material required for trouble-free sorption and desorption in the sorption container.

This geometrical shape of the sorption container of this form of embodiment also especially makes it possible for the original and or initial sorption and/or desorption behavior of a sorption unit to be largely maintained even if the layer volume of the sorption drying material in the sorption unit is compressed under its own weight during the lifetime of the dishwasher, i.e. settles and thus loses height. An advantageous direction specification of air flowing through the sorption container substantially in the direction of or against the direction of gravity, especially in a vertical direction in relation to a substantially horizontal penetration surface of the sorption unit, means that any material settlement of the sorption drying material has no disruptive effect or hardly any disruptive effect in respect of the functional integrity, i.e. especially moisture-absorbing, preferably water-absorbing capability and moisture-emitting, preferably water-emitting capability of the sorption unit. The functional integrity of the sorption drying system even continues to be ensured under such circumstances. This is because with the inventive construction, in respect of a substantially horizontal penetration surface of the sorption unit, at each point preferably in approximately the same layer, in particular filler conditions and thereby approximately the same through-flow conditions or the accompanying flow resistance conditions can be ensured over the product lifetime of the dishwasher, which allows optimum usage of the sorption and/or desorption capability of the sorption material with at the same time a smaller quantity of material. In addition impermissible material shifts which could lead to local accumulations of material or local thinning out of material and the accompanying adverse effects, additional stresses or even damage to the sorption drying material during the respective sorption process or desorption process, are largely avoided by the inventive geometrical form of the sorption container. Unlike in a sorption container which specifies a substantially horizontally-aligned support of the sorption unit and a horizontal flow of air through it, in the inventive geometrical shape of the sorption container, the air flowing through its sorption unit prespecifies or forces a passage or air with a through-flow direction substantially in or against the direction of gravity, especially thus in a vertical direction.

The sorption unit can be arranged in the sorption container such that the overall volume, especially filler volume of its sorption drying material, enables air from the washing container to flow through it substantially in a vertical through-flow direction against the direction of gravity. This means that the originally specified layering conditions, especially fill conditions of the sorption drying material, are essentially maintained at all locations of the entry cross-sectional surface of the sorption unit even after any material settlement during the lifetime of the dishwasher.

In particular the volume of the sorption drying material can advantageously have substantially the same layer height at any location behind the entry cross-sectional surface of the sorption unit, even if there is settlement of the material over the course of time. This means that largely homogeneous or similar through-flow conditions in respect of the respective passage cross-sectional surface of the sorption unit are always ensured, which favors or facilitates the respective sorption and desorption.

The sorption unit can be supported in the sorption container such that it is characterized by a substantially vertical through-flow direction. This largely avoids sorption drying material settlement being able to lead to a bypass channel being formed in the sorption unit in which less or even no sorption drying material is present. As a result of such an undesired, uneven sorption drying material distribution viewed over the through-flow cross-section of the sorption unit, its sorption effectiveness, desorption effectiveness and material ageing could be adversely affected.

The sorption container can in particular be embodied and arranged as a through-flow channel such that a substantially vertical direction of through-flow is prespecified in its through-flow area. In an advantageous manner it can especially form a chimney-type drying facility for the through-flowing air with vertical main passage direction for the respective sorption process or a chimney type heating facility with a vertical passage direction for the respective desorption process.

Usefully the sorption container can be embodied substantially pot-shaped, tubular, sleeve-shaped or cylindrical. These geometrical shapes are compact and make it easy to accommodate the sorption unit and if necessary one or more further components such as a heating device or flow conditioning elements for example. In such cases the sorption unit, viewed in the height direction around the intermediate space of its lower entry cross-sectional surface and its upper cross-sectional surface arranged at a predetermined height therefrom, have one or more sidewalls or jackets, which run partly or entirely especially in a substantially vertical plane, the respective jacket around the outer circumference of the sorption unit can especially also already be formed solely by one or more wall sections of the inner housing of the sorption container which encloses the sorption container. This advantageously specifies an outer envelope for the sorption drying material of the sorption unit, which extends in the height direction between its lower air inlet cross-sectional surface and its upper air outlet cross-sectional surface arranged at a predetermined height therefrom.

Furthermore the sorption container can advantageously comprise a substantially horizontally arranged base part and a substantially horizontally arranged top part. This enables the different elements or components of the sorption container to be assembled in a simple manner. In particular it can be useful for the sorption unit and/or if necessary a heating device arranged in front of it in the sorption container to form a largely vertically aligned sorption column or a sorption column placed on end. To accommodate such a sorption column a substantially vertically aligned envelope or cylindrical form of the sorption container can especially be useful.

The sorption drying material can in particular largely completely fill out a fill volume in the sorption unit of the sorption container which lies between the substantially horizontally arranged flow inlet cross-sectional surface and the flow outlet cross-sectional surface arranged largely in parallel thereto. Inside the housing jacket of the sorption container for this purpose a substantially horizontally arranged, lower base element which lets air through it is provided as a component of the sorption unit, on which its sorption drying material is supported. The housing of the sorption container advantageously simultaneously forms an edge side lateral jacket around the air-permeable base element such that the sorption drying material is laterally enclosed and held on the air-permeable base element with a desired layer or fill height. If necessary the sorption unit can also have its own lateral jacket or envelope, i.e., expressed in more general terms, one or more housing sidewalls around its outer circumference. Inside the housing jacket of the sorption container, if necessary usefully at a desired layer height from the lower air-permeable base element, at least one substantially horizontally arranged upper air-permeable top element can be provided as a component of the sorption unit. This means that the sorption material is largely reliably stored in the sorption unit between the lower base element and the upper top element.

In particular the sorption unit of the sorption container can have at least one lower, substantially horizontally arranged sieve element or grid element as an air-permeable base element and at least one upper, substantially horizontally arranged sieve element or grid element as an air-permeable top element, at a prespecified height from one another. The spatial volume between these two substantially horizontally arranged sieve elements or grid elements and the lateral housing jacket of the sorption container is usefully largely completely filled with sorption drying material in this case. This enables a desired storage and distribution of the sorption drying material over the entire lifetime of the dishwasher to be reliably maintained in a defined manner. In particular it allows it to be ensured that at all air inlet points of the inlet cross-sectional surface of the sorption unit the sorption drying material can be stored on the lower air-permeable base element with approximately the same, i.e. constant layer or filler thickness. This advantageously allows a largely homogeneous, even flow resistance at each point of the inlet cross-sectional surface of the sorption unit to be set. In particular a sorption unit or sorption column is formed in this way which, with compact dimensions, makes it possible to readily accept a specific volume of water from the air to be dried in the respective sorption process and at the same time makes possible an energy-efficient, largely complete expulsion of the stored water during the next desorption process. In addition, with this advantageous storage of the sorption material of the sorption unit, in which this especially has air flowing through it against the direction of gravity, the respective volume of sorption drying material through which airflow is then largely the same for all entry points of the air inlet cross-sectional surface, even if the sorption drying material has settled downwards during the product lifetime of the dishwasher and its layer, especially filler height, would be lower than if a constant layer height of sorption material volume was prespecified as the initial state in respect of all entry points of the inlet cross-sectional surface. The through-flow characteristic and the flow resistance characteristic then remain uniform for the sorption material volume of all entry points behind the air inlet cross-sectional surface of the sorption unit, the formation of an undesired bypass channel without or with too little sorption drying material within the sorption unit as well as local sorption material accumulations are thus largely avoided. This enables the entire sorption drying material in the sorption container to always be utilized in an energy-efficient manner for the respective sorption and desorption, since then in an advantageous manner a relatively small quantity of sorption drying material can suffice for achieving a desired sorption and desorption effect, the housing dimensions of the sorption container can be kept compact enough for a space-saving installation of the sorption container, especially in the base module below the base of the dishwasher.

To clean items to be washed, dishwashers run through wash programs which comprise a plurality of program steps. The respective wash program may comprise in particular the following individual program steps running consecutively over time: At least one prewash step with the addition of fluid, especially water, for removing coarse soiling, at least one cleaning step with the addition of detergent to fluid, especially water, at least one intermediate wash step, at least one rinse step with the application of liquid or water mixed with wetting agents or rinse aid, and a final drying step in which the cleaned items are dried. Depending on the cleaning step or wash cycle of a selected dishwashing program, fresh water and/or used water mixed with detergent is applied to the items to be washed in each case e.g. for a cleaning cycle, for the respective prewash cycle and/or intermediate wash cycle, fresh water to which at least one detergent has been added and/or used water, e.g. for the respective cleaning cycle or for the respective intermediate washing cycle and/or fresh water to which rinsing agent has been added and/or preferably clean used water for a final rinsing cycle for an intermediate rinse cycle and/or for a final rinse cycle is applied to the items to be washed in each case.

In accordance with one form of embodiment of the inventive dishwasher, the control device is configured so that, as a result of actuating the input means, the final rinse step is carried out completely without heating a rinsing agent used for the final rinse step, this enables the energy consumption of the inventive dishwasher to be reduced, since the rinsing agent does not have to be additionally heated, e.g. by a continuous-flow heater.

In accordance with a further variant of the inventive dishwasher its control device is configured such that, as a result of actuating the input means, the control device performs the drying step exclusively by means of the sorption drying system, in especially in conjunction with the variant as a result of which the rinsing agent is not additionally heated up, this produces a relatively marked energy-saving by comparison with a conventional dishwasher, since, at least during the final rinse step and the drying step which follows it, no additional continuous-flow heater has to be supplied with electrical energy.

To obtain an enhanced drying result (drying performance) the control device of the inventive dishwasher can also be configured such that, as a result of actuating the input means, the control device increases the duration of the drying step. This is especially advantageous when the drying step is exclusively carried out by means of the sorption drying system. This achieves improved drying of the items, especially all crockery, so that even a 100% drying of all crockery can be achieved.

The increase in the duration of the drying step can for example be achieved by the control device of the inventive dishwasher switching on a fan of the sorption drying system for a longer period of time.

An improved drying result for the items to be washed can alternately be achieved or additionally improved, if in accordance with a further form of embodiment of the inventive dishwasher, the control device, as a result of actuating the input means, controls the dishwasher so that a rinsing agent is heated up for the rinse step. This can be realized for example by the control device being connected to a continuous-flow heater and controlling the latter for heating up the rinsing agent. This makes it possible to achieve a 100% drying of all crockery.

In order to achieve a shorter "program duration" with the same cleaning results, i.e. to shorten the duration of the wash program, in accordance with a variant of the inventive dishwasher, the control device is configured such that, as a result of actuating the input means, the dishwasher is controlled so that a washing liquor used for the cleaning step and/or liquid used for the prewash step is heated up. This can be achieved for example by the control device being connected to a continuous-flow heater which is configured to heat up the cleaning liquid or the liquid, with the control device being configured to at least partly switch on the continuous-flow heater during the cleaning step or the prewash step. It is thus possible in accordance with this variant, when the sorption drying system is switched on, to reduce the program run time by comparison with conventional drying systems (without sorption drying). As a result of actuating the input means the control device can if necessary, in addition to heating up the respective washing liquor by means of a desorption process, also heat up the washing liquor, for example by means of the continuous-flow heater especially in the pump sump of the inventive dishwasher during the prewash step and/or the cleaning step.

The "program run time", i.e. the duration of the washing process, can alternately be shortened or additionally shortened even more if, in accordance with a further form of embodiment of the inventive dishwasher, the control device, as a result of actuation of the input means, controls the dishwasher such that, during the cleaning step and/or the prewash step, a spray pressure with which the cleaning liquid or the liquid is applied during the prewash step is increased. This can be achieved for example by the control device being connected to a circulating pump and operating a motor driving the circulating pump for the increased spray pressure at a higher speed. Furthermore the drying time can also be reduced by increasing the rinsing temperature.

As a result of the "sorption drying" drying system it is possible to keep the energy consumption at the same level as with conventional dishwashers, despite a shortened "program run time".

The control device of the inventive dishwasher can also be configured such that, as a result of actuation of the input means during the prewash and/or cleaning step, it immediately starts a desorption process of the sorption drying system. This makes it possible, with the run time remaining the same, to improve the cleaning results or the cleaning performance, without the energy consumption of the inventive dishwasher being higher than with conventional dishwashers.

Depending on the form of embodiment of the inventive dishwasher, this means that a program differentiation "sorption drying" is made possible by means of the input means, especially program buttons.

With an actuation of an "energy" button for example the emphasis is on saving energy. This is especially achieved by no heating taking place during rinsing and the drying of the crockery (generally: items to be washed) being achieved with the aid of sorption drying.

If a "drying performance" button is pressed, it can be possible to achieve a 100% drying (all crockery is dry). The adaptation of the washing program can especially be initiated by pressing a button. The increase in drying performance is for example achieved by increasing the drying time (increasing the time for which the fan of the sorption system runs) and/or by increasing the final rinse temperature by means of heating.

If a "program run time" button is pressed, by additional heating for example in the cleaning phase and for example optionally by raising the spray pressure, e.g. realized by increasing the motor speed of a circulating pump of the inventive dishwasher, the run time for cleaning the items to be washed can be reduced. In addition the drying time can also be reduced by increasing the final rinse temperature.

Because of the "sorption dying" drying system it is possible for the energy consumption of the inventive dishwasher to be at the same level as for conventional dishwashers.

If a "program performance" button is actuated, in a similar manner to the "program run time" button, the cleaning performance can be increased while the program time remains the same, without the energy consumption increasing by comparison with conventional dishwashers.

Other developments of the invention are described in the subclaims.

BRIEF DESCRIPTION OF THE DRAWINGS

An exemplary embodiment of the invention is shown by way of example in the enclosed schematic drawings, in which.

DETAILED DESCRIPTION OF EXEMPLARY EMBODIMENTS OF THE PRESENT INVENTION

Figure 1:
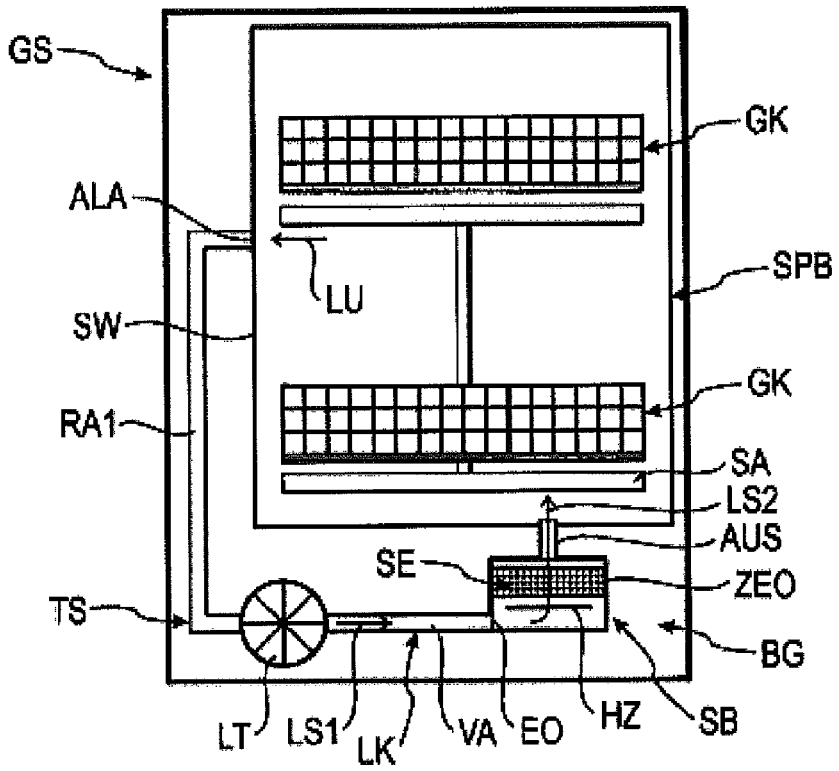
FIG. 1 shows schematically a household dishwasher comprising a washing container and a sorption drying system.

Elements having an identical function and mode of operation are in each case labeled with the same reference characters in FIGS. 1 to 18.

FIG. 1 shows in schematic representation a household dishwasher GS as an example of a dishwasher, which comprises as its main components a washing container SPB, a base module BG arranged thereunder and a sorption drying system TS. The sorption drying system TS is preferably provided externally, i.e. outside the washing container SPB, partially on a side wall SW and partially in the base module BG. It comprises as its main components at least one air-guiding channel LK, at least one fan unit or a blower LT inserted in said air-guiding channel and at least one sorption container SB. The washing container SB preferably accommodates one or more mesh baskets GK for receiving and for washing items such as crockery for example. One or more spray devices such as e.g. one or more rotating spray arms SA are provided in the interior of the washing container SPB for spraying the items to be cleaned with a liquid. In the exemplary embodiment here, both a lower spray arm and an upper spray arm are suspended to allow them to rotate in the washing container SPB.

To clean items to be washed, dishwashers run through wash programs which comprise a plurality of program steps. The respective wash program may comprise in particular the following individual program steps running consecutively over time: At least one prewash step with the addition of fluid, especially water, for removing coarse soiling, at least one cleaning step with the addition of detergent to fluid, especially water, at least one intermediate wash step, at least one rinse step with the application of liquid or water mixed with wetting agents or rinse aid, and a final drying step in which the cleaned items are dried. Depending on the cleaning step or wash cycle of a selected dishwashing program, fresh water and/or used water mixed with detergent is applied to the items to be washed in each case as washing liquid for the respective prewash cycle and/or intermediate wash cycle, fresh water and/or used water mixed with a cleaning agent for the respective washing cycle, or for the respective intermediate rinsing cycle, and/or fresh water mixed the rinsing agent and/or preferably clean used water for a final rinse cycle.

The fan unit LT and the sorption container SB are accommodated in the exemplary embodiment here in the base module BG underneath the base BO of the washing container SPB. The air-guiding channel LK runs from an outlet opening ALA which is provided above the base BO of the washing container SPB in a side wall SW thereof, externally on this side wall SW with an inlet-end tube portion RA1 down to the fan unit LT in the base module BG. The outlet of the fan unit LT is connected by means of a connecting section VA of the air-guiding channel LK to an inlet opening EO of the sorption container SB in a region thereof close to the base. The outlet opening ALA of the washing container SPB is provided in the exemplary embodiment here above the base BO thereof, preferably in the middle region or in the central region of the side wall SW, for sucking air out of the interior of the washing container SPB. Alternatively, it is of course also possible to fix the outlet opening in the back wall RW (see FIG. 2) of the washing container SPB. Viewed in more general terms, it can in particular be advantageous to provide the outlet opening preferably at least above a foam level up to which foam may form in a cleaning cycle or washing cycle, preferably in the upper half of the washing container in one of the side walls and/or back wall thereof. If necessary the outlet opening can also be provided in to top wall of the washing container. It can optionally also be useful to introduce multiple outlet openings in at least one side wall, top wall and/or the back wall of the washing container SPB and to connect these outlet openings by means of at least one air-guiding channel to one or more inlet openings in the housing of the sorption container SB before the beginning or start of the sorption material portion thereof. If necessary it can be useful to provide a number of air guiding channels simultaneously, i.e. in parallel next to each other, between the one or more outlet openings of the washing container SPB and the one or more inlet openings of the sorption container SB, The fan unit LT is preferably embodied as an axial fan. It serves to force moist hot air LU to flow out of the washing container SPB through a sorption unit SE in the sorption container SB. The sorption unit SE contains reversibly dehydratable sorption material ZEO which can absorb and store moisture from the air LU guided through it which is sucked out of the washing container SPB by the fan unit LT into the air guiding channel LK and the sorption container SB connected to it. The sorption container SB has an outflow opening AO (see FIGS. 4, 5) on the top side in the region of its housing GT close to the cover, said outflow opening being connected by means of an outlet element AUS through a through-insertion opening DG (see FIG. 13) in the base BO of the washing container SPB to the interior thereof. In this way, during a drying step of a dishwashing program for the drying of cleaned items, moist hot air LU can be sucked by means of the switched-on fan unit LT out of the interior of the washing container SPB through the outlet opening ALA into the inlet-end tube portion RA1 of the air-guiding channel LK and transported via the connecting section VA into the interior of the sorption container SB to be forced to flow through the reversibly dehydratable sorption material ZEO in the sorption unit SE. The sorption material ZEO of the sorption unit SE extracts water from the moist air flowing through it such that downstream of the sorption unit SE dried air can be blown via the outlet element or exhaust element AUS into the interior of the washing container SPB. In this way, this sorption drying system TS provides a closed air-circulation system. The spatial arrangement of the various components of this sorption drying system TS will emerge from the schematic perspective representation of FIG. 2 and the schematic side view of FIG. 3. In FIG. 3, the course of the base BO of the washing container SPB is additionally included in the drawing as a dashed and dotted line, which better illustrates the spatial/geometric proportions of the layout of the sorption drying system TS.

The outlet opening ALA is preferably arranged at a point above the base BO that enables the collection or suction of as much moist hot air LU as possible out of the upper half of the washing container SPB into the air-guiding channel LK, without the danger arising of liquid or foam reaching the washing container SB via the air guiding channel in an impermissible manner. This is because after the cleaning cycle, in particular rinse cycle with heated liquid, moist hot air collects preferably above the base BO, in particular in the upper half, of the washing container SPB. The outlet opening ALA lies preferably at a vertical position above the level of foam which can occur during regular washing or in the event of a malfunction. In particular, foam can be caused e.g. by detergent in the water during the cleaning cycle. In particular the position of the discharge point or outlet opening ALA will be advantageously chosen such that for the inlet-end tube portion RA1 of the air-guiding channel LK a still rising pathway on the side wall SW will be freely available. Placing the discharge opening or outlet opening in the central area, cover area and/or upper area of the side wall SW and/or back wall RW of the washing container SPB also largely prevents the possibility of water being injected out of the sump in the base of the washing container or out of the liquid spraying system thereof through the outlet opening ALA of the washing container SPB directly into the air-guiding channel LK during the respective cleaning or washing cycle and subsequently entering the sorption container SB, which there could otherwise render inadmissibly moist, partially damage or render unusable, or even completely destroy, the sorption material ZEO thereof.

At least one heating device HZ for desorption and thus regeneration of the sorption material ZEO is arranged in the sorption container SB upstream of the sorption unit SE thereof, viewed in the direction of flow. The heating device HZ and the downstream sorption unit SE form a substantially vertical sorption column arrangement. The heating device HZ serves to heat air LU which can be driven by means of the fan unit LT through the air-guiding channel LK into the sorption container for the respective desorption process. This forcibly heated air absorbs the stored moisture, in particular water, from the sorption material ZEO as it flows through the sorption material ZEO. This water which is expelled from the sorption material ZEO is transported by the heated air via the outlet element AUS of the sorption container SB into the interior of the washing container. This desorption process can preferably take place if the heating of the washing liquid is required for a cleaning cycle or other washing cycle. In this case the air heated by the heating device HZ for the desorption process, which flows through the sorption material of the sorption container, can simultaneously be used for heating the respective liquid in the washing container SPB, which is energy-saving.

Figure 2:
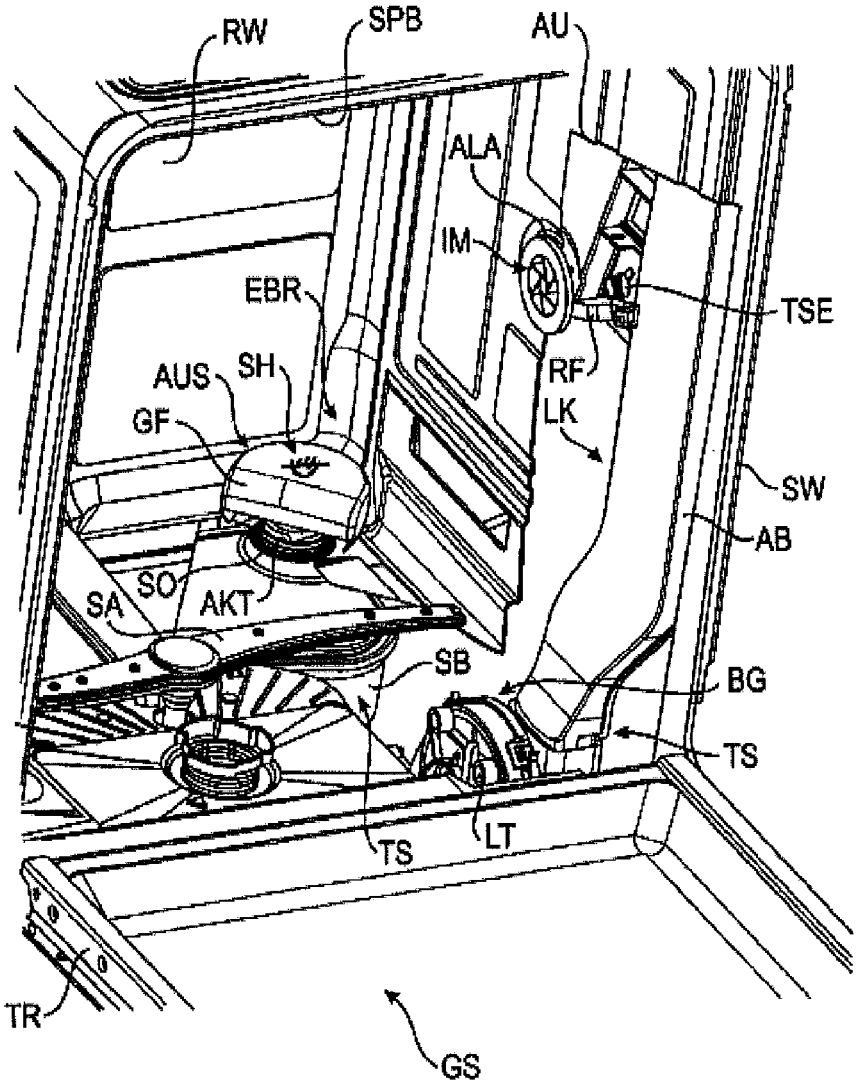
FIG. 2 shows schematically in perspective representation the open washing container of the dishwasher from FIG. 1 with components of the sorption drying system which are partially exposed, i.e. shown uncovered in the drawing.
Figure 3:
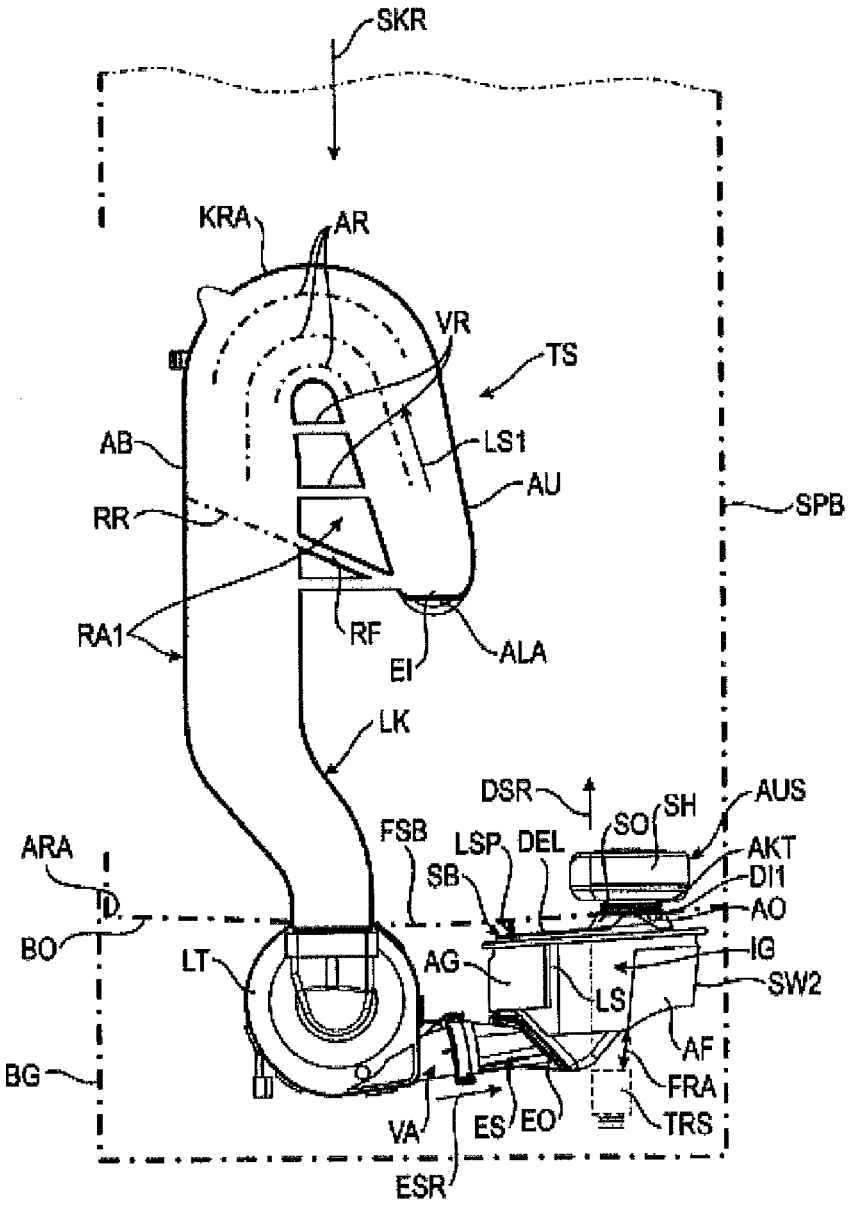
FIG. 3 shows in schematic side view the entirety of the sorption drying system from FIGS. 1, 2, the components of which are accommodated partially externally on a side wall of the washing container and partially in a base module underneath the washing container.

FIG. 2 shows, with the door TR of the dishwasher GS from FIG. 1 open, the main components of the sorption drying system TS in the side wall SW and the base module BG partially in an exposed state in a perspective representation. FIG. 3 shows, to accompany this, the totality of components of the sorption drying system TS, viewed from the side. The inlet-end tube portion RA1 of the air-guiding channel LK leading to the fan unit LT comprises, starting from the vertical position of its inlet opening EI at the location of the outlet opening ALA of the washing container SPB, a tube portion AU that is upwardly rising in relation to the direction of gravity and thereafter a tube portion AB that is downwardly descending in relation to the direction of gravity. In the case of the present exemplary embodiment, the upwardly rising tube portion AU runs somewhat obliquely upward relative to the vertical direction of gravity SKR and passes into a curved portion KRA, which is convexly curved and forces, with respect to the inflowing air flow LS1, a reversal of direction of approximately 180° downward into the adjacent, substantially vertically downward descending, tube portion AB. This tube portion ends in the fan unit LT which is accommodated in the base module BG. The first upwardly rising tube portion AU, the curved portion KRA and the downstream, second, downward descending tube portion AB form in the exemplary embodiment here a flat channel having a substantially flatly rectangular cross-sectional geometric shape. In this case the back and the front wall of the flat channel run substantially in parallel to the plane of the supporting side wall SW of the washing container, in particular the back wall of the flat channel is mounted on the side wall SW and is largely flat against it.

One or more flow-guiding ribs or drainage ribs AR are provided in the interior of the curved portion KRA, said ribs following the curved course thereof. In the exemplary embodiment, several arc-shaped drainage ribs AR are arranged substantially nested concentrically into one another and set at a transverse distance from one another in the interior of the curved portion KRA. They also extend in the exemplary embodiment here into the rising tube portion AU and into the descending tube portion AB over part of their length. These drainage ribs AR are arranged in vertical positions above the outlet ALA of the washing container SPB and of the inlet EI of the inlet-end tube portion RA1 of the air-guiding channel LK. Especially in the sorption cycle, in which steam is present in the washing container at the end of the rinsing cycle, these drainage ribs AR serve to take up droplets of liquid and/or condensation from the air flow LS1 sucked out of the washing container SPB. In the region of the section of the upwardly rising tube portion AU, the droplets of liquid collected on the flow-guiding ribs AR can drip in the direction of the outlet ALA. In the region of the downwardly descending tube portion AB, the collected droplets of liquid can drip from the flow-guiding ribs AR in the direction of at least one return rib RR. The return rib RR is provided at a point in the interior of the descending tube portion AB which lies higher than the outlet opening ALA of the washing container SPB and/or which lies higher than the inlet opening EI of the air-guiding channel LK. The return rib RR in the interior of the descending tube portion AB forms a drainage incline and aligns with a cross-connecting line RF in the direction of the outlet ALA of the washing container SPB. The cross-connecting line RF bridges the intermediate space between the arm of the upwardly rising tube portion AU and the arm of the downwardly descending tube portion AB. The cross-connecting line RF consequently connects the interior of the upwardly rising tube portion AU and the interior of the downwardly descending tube portion AB to one another. The gradient of the return rib RR and of the adjacent, aligned cross-connecting line RF is chosen in such a way as to ensure a return of condensation and/or other drops of liquid which drip down from the drainage ribs AR in the region of the descending tube portion AB into the outlet opening ALA of the washing container SPB. This obviates the need for a separate condensation-catching and return device in addition to the return channel.

The drainage ribs AR are preferably fitted on the inner wall of the air-guiding channel LK facing away from the side wall SW of the washing container because this exterior inner wall of the air-guiding channel is cooler than the inner wall of the air-guiding channel facing toward the washing container SPB. On this cooler inner wall condensation precipitates more intensely than on the inner wall of the air-guiding channel LK facing toward the side wall SW. Thus, it may suffice for the drainage ribs AR to be embodied as web elements which project from the outward lying inner wall of the air-guiding channel LK only over a partial width of the total cross-sectional width (i.e. this is the total height, viewed at right angles to the side wall) of the air-guiding channel embodied as a flat channel in the direction of the inward-lying inner wall of the air-guiding channel facing the side wall SW, such that, viewed in the depth direction, a lateral cross-sectional gap relative to the air through-flow remains. It may, however, optionally also be useful to embody the drainage ribs AR between the outward lying inner wall and the inward lying inner wall of the air-guiding channel LK as a continuous air guidance rib. In this way, particularly in the curved portion KRA, by providing a plurality of individual air guiding channels separated from one another, a more targeted guidance and redirection of air can be achieved, since their narrower air through-flow cross sections enable the through-flow speed for the respective through-flowing air mass to be increased. Disruptive air turbulence is thus largely avoided. A desired volume of air can in this way be conveyed through the air-guiding channel LK embodied as a flat channel.

The return rib RR is preferably fitted as a web element on the inside of the outward-lying inner wall of the air-guiding channel LK, said web element projecting over a partial width or partial extent of the total extent of the flat-design air-guiding channel LK in the direction of the inward-lying inner wall thereof. This ensures that an adequate passage cross-section remains free in the region of the return rib RR for the air flow LS1 to flow through. Alternatively, it can of course also be useful to embody the return rib RR as a continuous element between the outside inner wall and the inward-lying inner wall of the air-guiding channel LK and to provide in particular centrally located passage openings for the passage of air.

The drainage ribs AR and the return rib RR serve in particular to separate water droplets, detergent droplets, rinse aid droplets and/or other aerosols which are found in the inflowing air LS1 and to return them through the outlet opening ALA into the washing container SPB. This is particularly advantageous in a desorption process when a cleaning step or other washing cycle with heating of the washing liquid is taking place simultaneously. Otherwise the desorption process could namely be adversely effected, since the sorption material would be made impermissibly wet or moist by such aerosols taken in. During the respective cleaning step or washing step, a relatively large amount of steam or mist may be located in the washing container SPB, in particular due to the spraying of washing solution by means of the spray arms SA. Such steam and mist may contain both water and detergent, rinse aid and/or optionally other cleaning substances finely distributed. For these dispersed liquid particles carried along in the air flow LS1, the drainage ribs AR form a separating device. Instead of drainage ribs AR, other separating means can alternately also advantageously be provided, in particular structures having a multiplicity of edges such as e.g. wire meshes.

In particular, the obliquely upwardly or substantially vertically rising tube portion AU ensures that liquid droplets or even spray jets which are sprayed out by a spraying device SA such as, for example, a spay arm, during the cleaning cycle or other wash cycle, are largely prevented from being able to reach the sorption material ZEO of the sorption container SB directly via the sucked-in air flow LS1. Without this retention or this separation of liquid droplets, in particular mist droplets and steam droplets, the sorption material ZEO could be rendered inadmissibly moist and unusable for a sorption process in the drying step. In particular, premature saturation could occur due to the infiltration of liquid droplets such as e.g. mist droplets or steam droplets. The inlet-end rising branch AU of the through-channel and/or the one or more separating and capturing elements in the upper bend region and apical region of the curved portion KRA between the rising branch AU and the descending branch AB of the through-channel moreover also largely prevent detergent droplets, rinse-aid droplets and/or other aerosol droplets from being able to pass further down beyond this barrier to the fan LT and from there into the sorption container SB. Of course, it is also possible to provide in place of the combination of rising tube portion AU and descending tube portion AB and in place of the one or more separating elements a differently-embodied barrier arrangement with the same filter function.

To sum up, the dishwasher GS in the exemplary embodiment here comprises a drying device for drying items to be washed through sorption by means of reversibly dehydratable sorption material which is stored in a sorption container SB. Said sorption container is connected via at least one air-guiding channel to the washing container SPB for generating an air flow. The air-guiding channel has along its inlet-end tube portion a substantially flatly rectangular cross-sectional geometric shape. This advantageously enables it to be accommodated in the space between at least one outer wall of the washing container and an outer housing of the household dishwasher GS in a space-saving manner. Viewed in the direction of flow, after its inlet-end tube portion, which lies over the outlet opening of the washing container, the air-guiding channel passes into a substantially cylindrical tube portion, with which it opens out into the fan unit. It is preferably manufactured from at least one plastic material. It is arranged in particular in the intermediate space between a side wall and/or back wall of the washing container and an outer housing wall of the household dishwasher GS. In this case the air-guiding channel advantageously comprises at least one upwardly rising tube portion. It extends upward starting from the discharge opening of the washing container. Advantageously it also comprises after the rising tube portion, viewed in the direction of flow, at least one downwardly descending tube portion. At least one curved portion is provided between the rising tube portion and the descending tube portion. The curved portion has in particular a greater cross-sectional area than the rising tube portion and/or the descending tube portion. One or more flow-guiding ribs for equalizing the air flow are provided in the interior of the curved portion. At least one of the flow-guiding ribs optionally extends beyond the curved portion into the rising tube portion and/or descending tube portion. The one or more flow-guiding ribs are provided in positions above the vertical position of the outlet of the washing container. The respective flow-guiding rib can extend from the channel wall facing the washing-compartment housing to the opposing channel wall of the air-guiding channel facing away from the washing-compartment housing on a part depth length or part cross-sectional width, preferably substantially continuously. In particular at least one return rib can be provided in the interior of the descending tube portion on the channel wall facing the washing-compartment housing and/or channel wall of the air-guiding channel LK facing away from the washing-compartment housing at a point which lies higher than the inlet opening of the air-guiding channel. The return rib can usefully be connected to the inlet opening of the air-guiding channel via a cross-connecting line in the intermediate space between the rising tube portion and the descending tube portion for returning condensate. It preferably exhibits a gradient toward the inlet opening. The return rib can extend from the channel wall facing the washing-compartment housing to the opposing channel wall of the air-guiding channel facing away from the washing-compartment housing preferably only over a partial cross-sectional width.

In FIG. 3, the descending branch AB of the air-guiding channel LK is introduced substantially vertically into the fan unit LT. The air flow LS1 which is sucked in is blown by the fan unit LT at the output end via a tubular connecting section VAS into an inlet connecting piece ES of the sorption container SB coupled thereto into the region in the vicinity of the base thereof. The air flow LS1 flows into the lower region of the sorption container SB with an inflow direction ESR and switches to a different flow direction DSR with which it flows through the interior of the sorption container SB. This substantially vertical through-flow direction DSR runs from bottom to top through the sorption container SB. In particular, the inlet connecting piece ES steers the incoming air flow LS1 into the sorption container SB in such a way that said air flow is diverted from its inflow direction ESR in particular by approximately 90 degrees into the through-flow direction DSR through the sorption container SB.

Figure 10:
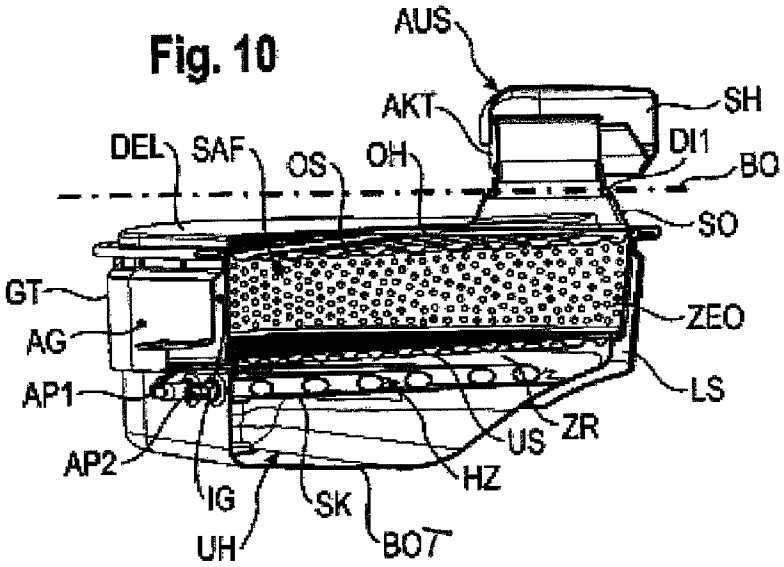
FIG. 10 shows in schematic perspective representation the internal structure of the sorption container of FIGS. 4, 5, 9 in a partially cutaway state.
Figure 11:
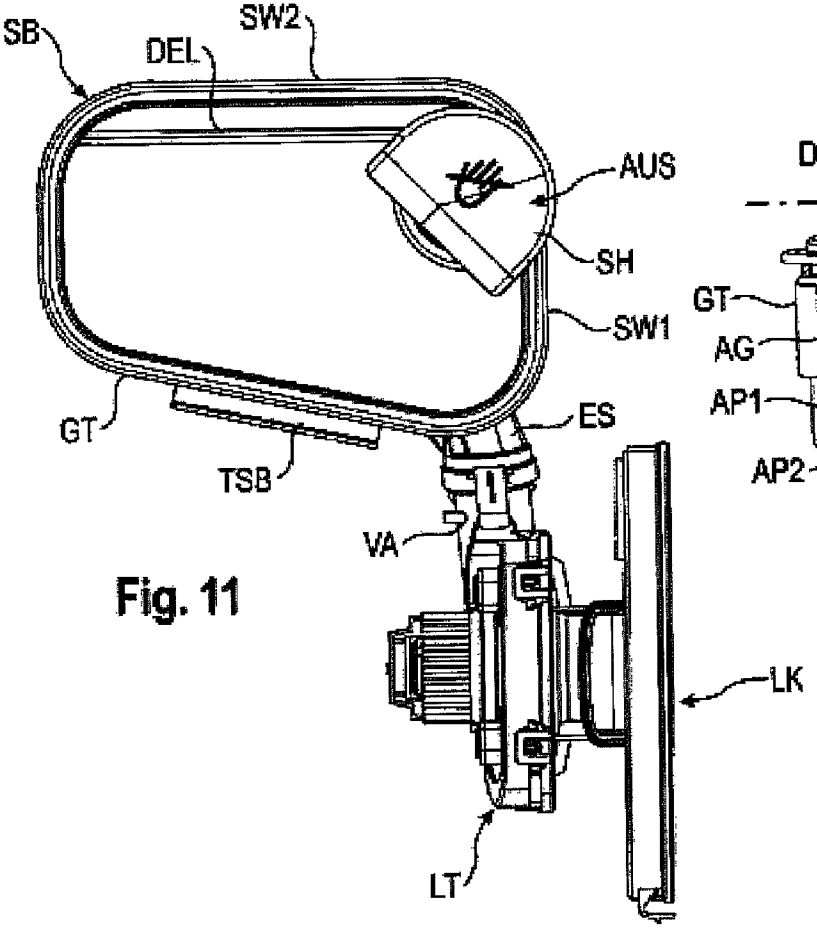
FIG. 11 shows in schematic plan representation, viewed from above, the entirety of the components of the sorption drying system of FIGS. 1 to 10, FIGS. 12 to 14 show schematically in various views the outlet element of the sorption drying system of FIGS. 1 to 3 as an individual item.
Figure 12:
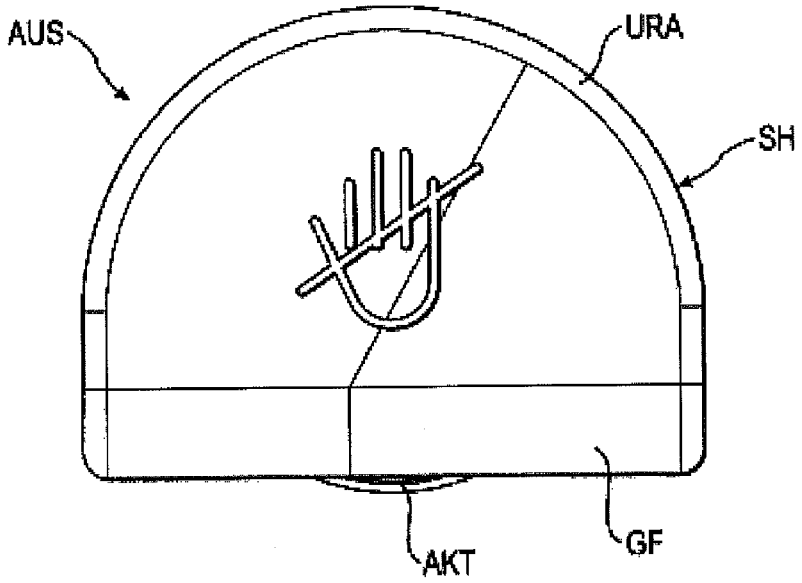

In accordance with FIG. 3, the sorption container SB is arranged underneath the base BO in a base module BG of the washing container SPB in a largely freely-suspended manner such that for heat protection it has a predefined minimum gap distance LSP in relation to neighboring components and/or parts of the base module BG (see also FIG. 10). For the sorption container SB attached in a freely-suspended manner under the base BO of the washing container, at least one transport securing element TRS is provided below said sorption container at a predefined clearance distance FRA such that the sorption container SB is supported from below in case the sorption container SB moves down from its freely-suspended position together with the base BO during transport.

Expressed in general terms, the housing of the sorption container SB has a geometric shape such that circumferentially an adequate gap distance exists from the other parts and components of the base module BG as heat protection. For example, the sorption container SB has for this purpose on its housing wall SW2 facing the back wall RW of the base module BG an arched shape AF which corresponds to the geometric shape of the back wall RW of the washing container SB facing it.

In an advantageous manner the sorption container SB has the least one outer housing AG in addition to its pot-shaped inner housing IG enclosed by a cover element in the deposit area of its sorption unit SE such that its overall housing GT is embodied as a double-walled housing in this area. An air gap is thus present between the inner housing IG and the outer housing AG as a heat insulation layer.

The fact that the sorption container SB, at least around the support area of its sorption unit, i.e. partly or completely, is embodied as at least a double walled unit, means that, in addition to or independently of its freely-suspended position or accommodation, a barrier and/or a heat radiation protection is provided. In particular this further overheating protection measure serves on the one hand to adequately protect any adjacent chips and components of the base module BG from the impermissibly high overheating or combustion. On the other hand the multiwall nature of the sorption container SB has the function, as a barrier, of avoiding heat losses of the sorption unit to the environment, which allows the energy efficiency in the respective desorption cycle in which the sorption material is heated by means of at least one air heating device for driving out liquid, especially water, to be increased compared to a sorption container without a barrier. In addition the sorption material volume of the sorption unit can be heated up through the multiwall nature of the sorption container SB more evenly for desorption than without heat barrier means, which gives greater protection to the sorption material. In addition this type of double-walled or in general terms multiwall construction of the sorption container SB is cheaper and simpler to manufacture than additional barrier mats. In the case of the present exemplary embodiment of FIG. 3 the sorption container SB has the cutaway outer wall AG projecting freely downwards on its cover part DEL which, as an outer protective jacket, encloses the wall IG of the pot-shaped overall housing GT close to the top with the cover part DEL in the area of the sorption unit SE at a predefined transverse spacing LS. As an alternative or in addition to the enclosed outer wall AG, it may also be possible to provide an additional inner wall inside the sorption container SB in addition to its housing wall IG at least in the area of the sorption unit SE.

In addition or independently of the multiwall construction of the sorption container SB it can also be useful, at least in the support area of the sorption unit all around this outside on the housing of the sorption container SB and/or inside on the inner wall of the sorption container SB to provide at least one heat-resistant insulation element. This can for example be heat-insulating fleece, mats or the like.

Figure 13:
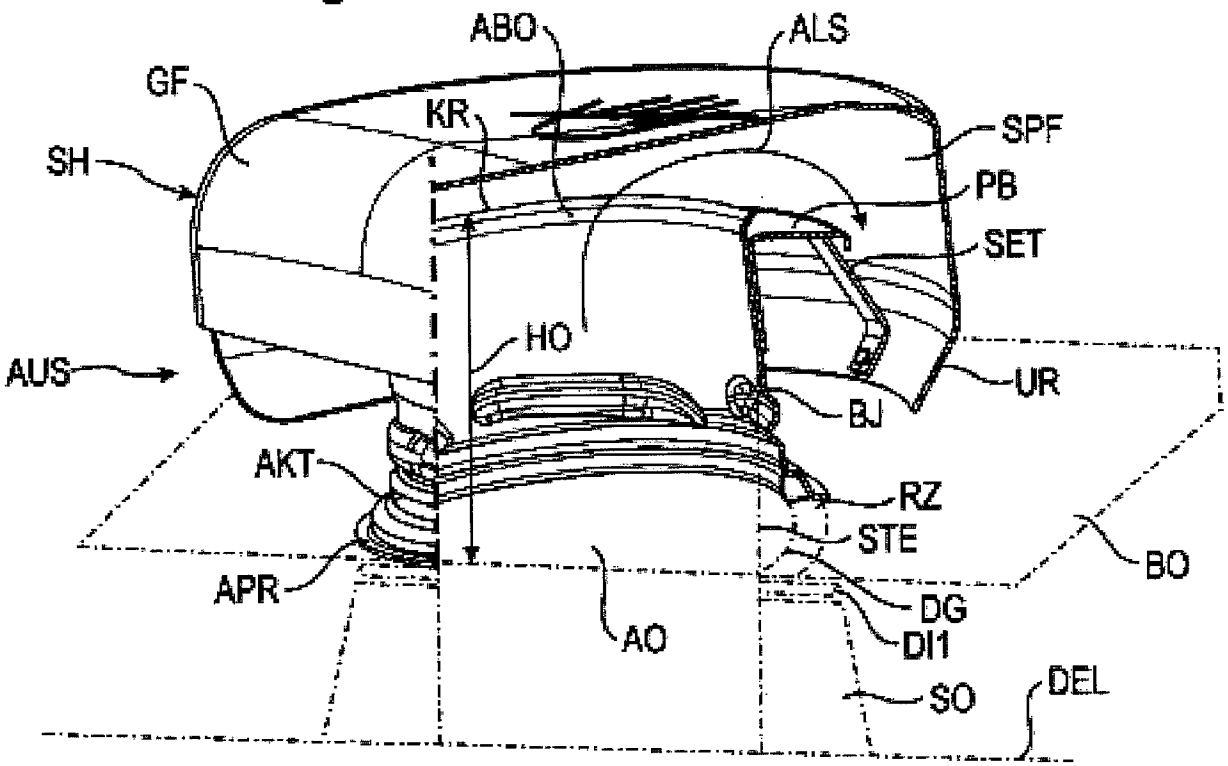

The sorption container SB is mounted on the underside of the base BO, in particular in the region of a through-opening DG (see FIGS. 3, 13) of the base BO of the washing container SPB. This is illustrated in particular in the schematic side view of FIG. 3. There, the base BO of the washing container SPB has, starting from its outer edges ARA, a gradient running toward a liquid collecting area FSB. This liquid collecting area FSB is especially arranged in the locality of the pump sump of the dishwasher. Preferably this is provided in approximately the central area of the base BO. The sorption container SB is mounted on the base BO of the washing container SPB in such a way that its cover part DEL runs substantially parallel to the underside of the base BO and at a predefined gap distance LSP therefrom. For positioning the sorption container SB in a freely-suspended manner, a coupling connection is provided between at least one coupling component on the underside of the base, in particular a socket SO, of the sorption container SB and a component on the top side of the base, in particular the outlet element AUS, of the sorption container SB in the region of a through-opening DG in the base BO of the washing container SPB. As a coupling connection, a clamping connection, in particular, is provided. The clamping connection may be formed by a detachable connection, in particular screw connection, with or without bayonet catch BJ (see FIG. 13) between the component of the sorption container SB on the underside of the base and the component of the sorption container SB on the top side of the base. An annular edge zone RZ (see FIG. 13) around the one through-opening DG of the base BO is clamped between an outlet component on the underside of the base such as e.g. SO of the sorption container SB, and the outlet element or spray protection component AUS arranged above the base BO in the assembled state of the two coupling components. In FIG. 13, the base BO and subpart on the underside of the base are, for the sake of drawing simplicity, indicated merely by dot-dash lines. The outlet component on the underside of the base and/or the spray protection component AUS on the top side of the base projects with its end-face end portion through the through-opening DG of the base BO. The outlet part on the underside of the base comprises a socket SO around the discharge opening AO of the cover part DEL of the sorption container SB. The spray protection component AUS on the top side of the base comprises an outflow connecting piece AKT and a spray protection hood SH. At least one sealing element DI1 is provided between the component AUS on the top side of the base and the component SO on the underside of the base.

In summary, the sorption container SB is thus arranged beneath the base BO of the washing container SPB in a largely freely-suspended manner such that for heat protection it has a predefined minimum gap distance LSP in relation to neighboring components and parts of the base module BG. Below the sorption container SB a transport securing element TRS is additionally fixedly attached at a predefined clearance distance FRA to the base of the base module. This transport securing element TRS serves to brace, if necessary from below, the sorption container SB mounted in a freely-suspended manner below the base BO of the washing container SPB, if said sorption container oscillates downward together with the base BO, for example during transportation, due to vibrations. This transport securing element TRS may, in particular, be formed by a metal bracket bent downward in a U-shaped manner which is fixedly mounted on the base of the base module. The sorption container SB has on the top of its cover part DEL the outflow opening AO. An upwardly projecting socket SO is fitted around the outer rim of this outflow opening AO. A cylindrical socket connection element STE is fitted in the approximately circular opening of this socket SO (see FIGS. 4, 5, 9, 13), said element projecting upwardly and serving as a counterpart to the outflow connecting piece or exhaust chimney connecting piece AKT to be fastened thereto. It preferably has an external thread with integrated bayonet catch BJ, which interacts appropriately with the internal thread of the exhaust chimney connecting piece AKT. The socket SO has on its top seating edge running concentrically around the socket connecting piece STE the sealing ring DI1. This is illustrated in FIGS. 3, 4, 9, 13. The sorption container SB rests firmly pressed with this sealing ring DI1 against the underside of the base BO. It is held by the height of the socket SO at a distance or spacing LSP from the underside of the base BO. The exhaust chimney connecting piece AKT is inserted down through the through-opening DG of the base BO from the top of the base BO and screwed to the counterpart socket connecting piece STE and secured from opening by the bayonet catch BJ. The exhaust chimney connecting piece AKT abuts firmly, encircling the outer edge zone RZ of the base BO around the through-opening DG with its annular outer edge APR, because the outer edge zone RZ of the base BO around the through-opening DG is clamped in a liquid-tight manner between an encircling lower seating edge APR of the exhaust chimney connecting piece AKT and the upper seating edge of the socket AO by means of the sealing ring DI1 arranged there. Since the sealing ring DI1 presses on the base BO from the underside, it is protected against any impairments or damage by detergents in the washing solution from ageing. A liquid-tight through-connection between the exhaust chimney connecting piece AKT and the socket SO is formed in this way. This simultaneously functions advantageously as a suspension device for the sorption container SB.

The fact that the socket SO projects by a socket height LSP above the remaining surface of the cover part DEL ensures that a gap clearance is present between the cover part DEL and the underside of the base BO. The base BO of the washing container SPB in the exemplary embodiment here from FIG. 3 runs, starting from its encircling edge zone with the side walls SW and the back wall RW, with a gradient in an obliquely inclined manner toward a preferably central liquid-collecting area FSB. The pump sump PSU of a circulating pump UWP may be located therebelow (see FIG. 16). In FIG. 3, this base BO running from the outside inward at an incline toward the lower lying collecting area FSB is drawn in dashed and dotted lines. The arrangement of the pump sump PSU with the circulating pump UWP sitting therein underneath the lower lying collecting area FSB can be seen from the plan-view image of the base module from FIG. 16. The sorption container SB is preferably mounted on the base BO of the washing container SPB such that its cover part DEL runs substantially parallel to the underside of the base BO and at a predefined gap distance LSP therefrom. To this end, the socket SO is placed on the socket connecting piece STE sitting therein obliquely at an appropriate angle of inclination relative to the surface normal of the cover part DEL.

According to FIGS. 4 to 10, the sorption container SB comprises a pot-type housing part GT which is closed by means of a cover part DEL. There is provided in the pot-type housing part GT at least the sorption unit SE comprising reversibly dehydratable sorption material ZEO. The sorption unit SE is accommodated in the pot-type housing part GT in such a way that an air flow LS2 can flow through its sorption material ZEO substantially in or against the direction of gravity SKR (see FIG. 3), said air flow LS2 being generated through diversion of the air flow LS1 brought via the air-guiding channel LK. The sorption unit SE comprises at least one lower sieve element or grid element US as a lower, substantially horizontally-arranged air-permeable base element and at least one upper sieve element or grid element OS as an upper, substantially horizontally-arranged air-permeable base element at a predefinable vertical distance H from one another (see in particular FIG. 9). The spatial volume between the two sieve elements or grid elements US, OS is to a large extent completely filled with the sorption material ZEO. At least one heating device HZ is provided in the pot-type housing part GT. Said heating device is, viewed in the through-flow direction DSR of the sorption container SB, provided in particular upstream of the sorption unit SE comprising the reversibly dehydratable sorption material ZEO. The heating device HZ is provided in a lower cavity UH of the pot-type housing part GT for collecting inflowing air LS1 from the air-guiding channel LK. The inlet opening EO for the air-guiding channel LK is provided in the area of its base part BOT. The discharge opening AO for the outlet element AUS is provided in the cover part DEL. A heat-resistant material, in particular metal sheet, preferably stainless steel or a stainless steel alloy, is preferably used for the cover part DEL and the pot-type housing part GT, i.e. expressed in general terms a heat-resistance material, especially sheet metal, preferably stainless steel or a stainless steel alloy is preferably used to all parts of the overall housing of the sorption container. The cover part DEL closes off the pot-type housing part GT to a large extent hermetically. The circumferential outer edge of the cover part DEL is connected to the upper edge of the pot-type housing part GT only by a mechanical connection, in particular by a deforming connection, a joining connection, a latching connection, a clamping connection, in particular by a beaded connection or a clinched connection, which is simple in manufacturing terms and ensures a permanent heat-resistant and sealed connection. The pot-type housing part GT comprises one or more side walls SW1, SW2 (see FIG. 5) which run substantially vertically. It has an external contour which corresponds substantially to the internal contour of an installation area EBR provided for it, in particular in a base module BG (see FIG. 16). The two adjacent side walls SW1, SW2 have external surfaces which run substantially at right angles to one another. At least one side wall such as e.g. SW2, has at least one shape such as e.g. AF (see FIG. 3) which is embodied in a substantially complementary manner to match a shape on the back wall and/or side wall of the base module BG, which is provided under the base BO of the washing container SPB. The sorption container SB is provided in a rear corner area EBR between the back wall RW and an adjacent side wall SW of the dishwasher GS in a free spec of the base module BG.

Figure 4:
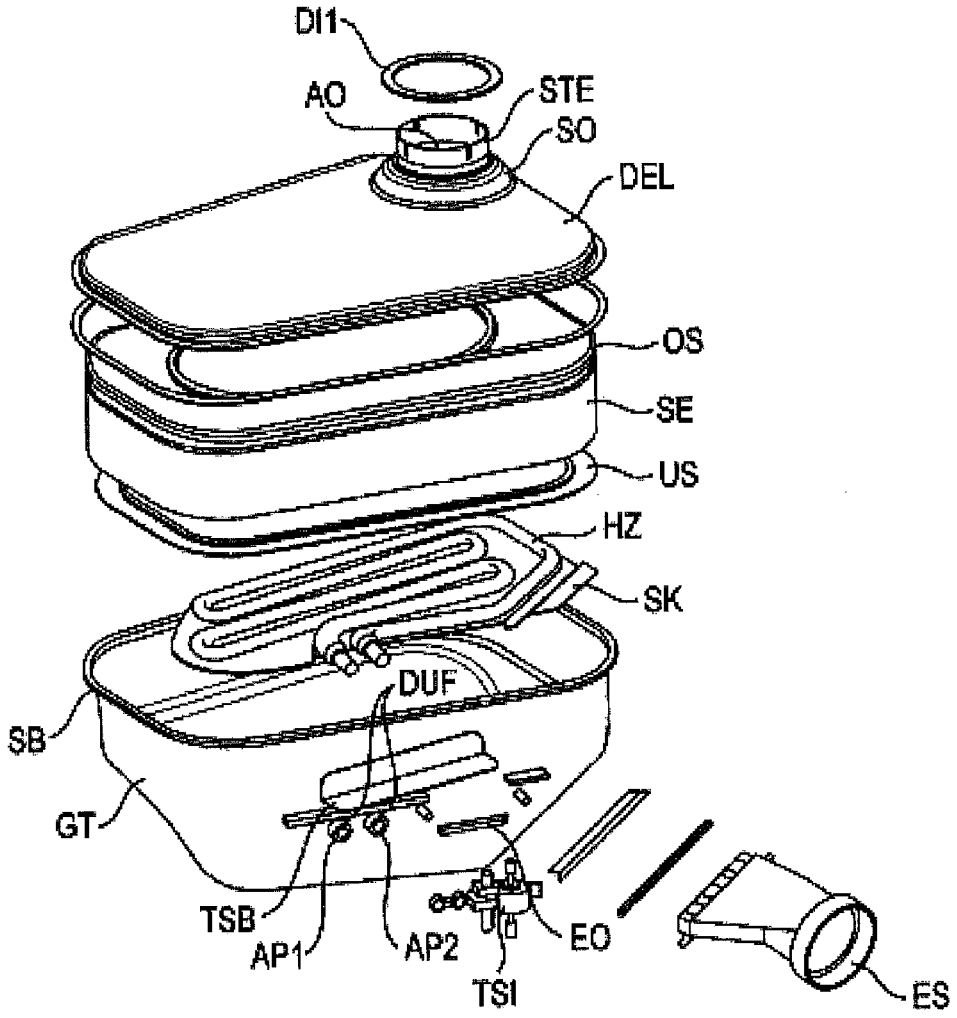
FIG. 4 shows as an individual item schematically in exploded perspective representation various components of the sorption container of the sorption drying system from FIGS. 1 to 3.
Figure 5:
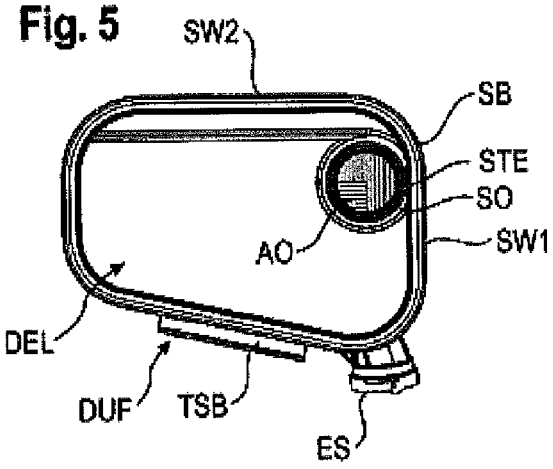
FIG. 5 shows schematically in plan view the sorption container from FIG. 4.
Figure 8:
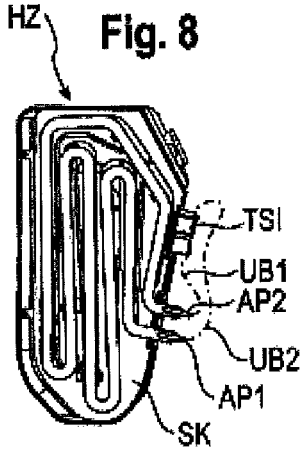
FIG. 8 shows in schematic plan representation, viewed from above, the coiled-tube heater from FIG. 7 which is arranged above the slotted sheet from FIG. 6.
Figure 9:
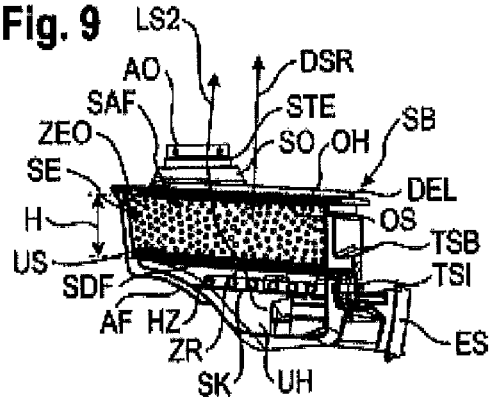
FIG. 9 shows in schematic sectional representation, viewed from the side, the sorption container of FIGS. 4, 5.
Figure 6:
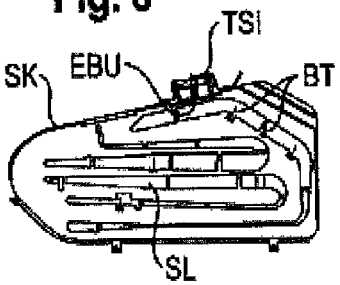
FIG. 6 shows in schematic plan view from below, as a component of the sorption container from FIG. 5, a slotted sheet for the flow conditioning of air which flows through sorption material in the sorption container.
Figure 7:
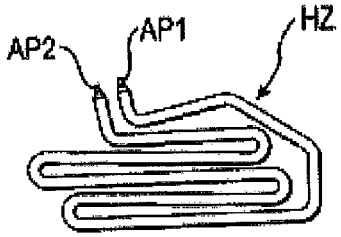
FIG. 7 shows in schematic plan view from below, as a further detail of the sorption container from FIG. 4, a coiled-tube heater for heating sorption material in the sorption container for the desorption thereof.

The pot-type housing part GT comprises at least one through-opening for at least one electrical contact element, especially two through-openings DUF here for two electrical contact elements, preferably connection poles AP1, AP2 (see FIGS. 4, 5). A drip-protection sheet TSB is mounted for additional safety in a canopy area above the through-opening DUF at least over the extent thereof. The drip-protection sheet TSB has a drainage incline. This drip protection sheet largely avoids moisture or liquid, from the inside of the washing container, e.g. through any edge gap remaining as a result of an error between the inner edge of the through-opening DG and the socket SO and/or connecting piece AKT of the coupling components SO, AUS despite sealing element DI1 or in another manner such as for example through a leak in the base BO or in a line of the liquid circulation system with the circulating pump UMP, being able to come into contact with the electrical contact elements. This cover is thus used for electrical safety.

FIG. 4 shows in a schematic and perspective exploded view the various components of the sorption container SB in a disassembled state. Viewed in a vertical direction the components of the sorption container SB are arranged in multiple positional planes above one another. This structural design, layered from bottom to top, of the sorption container SB is illustrated in particular in the sectional view of FIG. 9 and in the sliced perspective representation of FIG. 10. The sorption container SB comprises the lower cavity UH close to the base for collecting inflowing air from the inlet connecting piece ES. Above this lower cavity UH sits a slotted sheet SK which serves as a flow-conditioning means for a coiled-tube heater HZ arranged thereabove. The slotted sheet SK sits on a circumferential supporting edge around the interior of the sorption container SB. This supporting edge has a predefined vertical distance relative to the inner base of the sorption container SB for forming the lower cavity UH. The slotted sheet SK preferably has one or more clamping parts in order to clamp it laterally or on the side to a partial surface, to at least one inner wall of the sorption container SB. A reliable securing in position of the slotted sheet SK can be provided by this means. In accordance with the view of the slotted sheet from below of FIG. 6, this slotted sheet has slots SL which substantially follow the course of the coil of the coiled-tube heater arranged over the slotted sheet SK. The slots or passages SL of the slotted sheet SK are embodied larger, in particular wider or broader, at those locations at which the air flow LS1 entering the sorption container SB has a lower velocity in the through-flow direction DSR through the sorption container than at those locations at which the air flow LS1 entering the sorption container has a greater velocity in the through-flow direction DSR through the sorption container SB. This achieves to a large extent an equalization of the local flow cross-sectional profile of the air flow LS2, which flows through the sorption container SB from bottom to top in a through-flow direction DSR. Within the scope of the invention, equalization of the local flow cross-sectional profile of the air flow is understood in particular to mean that substantially the same volume of air passes through with approximately the same flow velocity substantially at every entry point of a through-flow surface.

The coiled-tube heater RZ is arranged, viewed in the direction of flow-through DSR, with a predefined vertical clearance behind the slotted sheet SK. To achieve this, it can be held by means of a multiplicity of sheet parts BT which are embodied in a web-like manner at a vertical distance above the passages SL. These sheet parts BT (see FIG. 6) support preferably alternately from below and from above the run of the coiled-tube heater. This makes it possible firstly for the coiled-tube heater HZ to be reliably secured in position above the slotted sheet SK. Secondly, warping of the slotted sheet SK which can occur under the heat generated by the coiled-tube heater HZ is largely avoided. Viewed in the through-flow direction DSR, the coiled-tube heater HZ is followed by a free intermediate space ZR (see FIGS. 9, 10) until the rising, substantially from bottom to top, air flow LS2 enters the inlet cross-sectional area SDF of the sorption unit SE. This sorption unit SE comprises on the inlet side a lower sieve element or grid element US. An outlet-side upper sieve element or grid element OS is provided at a vertical distance H from this sieve element or grid element US. For the two sieve elements US, OS, supporting edges are provided in portions of or all around the inner walls of the sorption container in order to position and to hold the sieve elements US, OS in their assigned vertical position. The two sieve elements US, OS are preferably arranged parallel to one another at this predefined vertical distance H. Between the lower sieve element US and the upper sieve element OS, the sorption material ZEO is filled such that the volume between the two sieve elements US, OS is largely completely filled. When the sorption container SB is in the installed state, the inlet-end sieve element US and the outlet-end sieve element OS are arranged, relative to the vertically running central axis of the sorption container SB and relative to the through-flow direction DSR thereof, in substantially horizontal positional planes above one another at the predefined vertical distance H from one another. In other words, the sorption unit SE is therefore formed here in the exemplary embodiment here by a filling volume of sorption material ZEO between a lower sieve element US arranged substantially horizontally and an upper sieve element OS arranged substantially horizontally, with these being connected to one another by the side walls extending in the height direction, especially through-flow direction DSR, of the sorption container SB as the outer envelope of the sorption unit and are surrounded by the later. The sorption unit is thus embodied in the form of an envelope or in the form of a tube. The sorption material ZEO is supported on the lower sieve element US in this case and is held in position by said element as well as by the outer walls or the inner housing IG respectively of the sorption container. Viewed in the through-flow direction DSR, the upper cavity OH for collecting outflowing air is provided above the sorption unit SE. This outflowing air LS2 is guided by the outlet AO of the socket connecting piece STE into the exhaust chimney connecting piece ATK, from where it is blown out into the interior of the washing container SPB.

In summary, the sorption material ZEO fills a fill volume between the lower sieve element US and the upper sieve element OS so that it has the flow inlet cross-sectional area SDF and a flow discharge cross-sectional area SAF substantially perpendicular to the through-flow direction DSR which runs substantially in a vertical direction. The lower sieve element US, the upper sieve element OS and the sorption material ZEO embedded therebetween each have penetration areas which are congruent in relation to one another for the through-flowing air LS2. This largely ensures that at each point in the volume of the sorption unit SE, the sorption material thereof can be subjected to approximately the same volume flow. During desorption, points of overheating and thus any overloading or other damage to the sorption material ZEO are in this way largely prevented. During sorption, uniform absorption of moisture from the moist air to be dried and thus optimum use of the sorption material ZEO provided in the sorption unit SE is consequently enabled.

Flow-conditioning or flow-influencing of the flow LS2 rising from bottom to top in the through-flow direction DSR is performed by the slotted sheet SK such that substantially the same air volume flow flows around the coiled-tube heater substantially at each point of its longitudinal extent. The combination of slotted sheet and coiled-tube heater HZ arranged thereabove to a large extent ensures that the air flow LS2 can be heated largely uniformly during the desorption process upstream of the inlet area of the lower sieve US. In this case the slotted sheet provides for a largely uniform local distribution of the heated air volume flow viewed over the inlet cross-sectional area SDF of the sorption unit SE.

In addition to or independently of the slotted sheet SK, it can optionally also be useful to provide a heating device outside the sorption container SB in the connecting section between the fan unit LT and the inlet opening EO of the sorption container SB. Because the passage cross-sectional area of this tubular connecting section VA is less than the average cross-sectional area of the sorption container SB for an air flow, the air flow LS1 may, before it enters the sorption container SB, already be heated largely uniformly for the desorption process in advance. The slotted sheet SK can then optionally be omitted completely.

Particularly if the heating of the air is carried out by means of a heating device in the sorption container SB, it can optionally also be useful to provide, viewed in the through-flow direction DSR of the sorption container SB, both upstream and downstream of the heating device HZ at least one flow-conditioning element in each case such that approximately the same air volume flow can flow at each point through the amount by volume of sorption material ZEO behind the inlet cross-sectional area SDF of the lower sieve element US. In this way, in particular also during the sorption process during which the heating device HZ is deactivated, i.e. is switched off, it is largely achieved that all the sorption material is to a large extent completely involved in the dehumidification of the through-flowing air LS1. In an analogous manner, in the desorption process in which the through-flowing air LS2 is heated up by the heating device HZ, stored water is caused to re-emerge from all the sorption material in the intermediate space between the two sieve elements US, OS such that at all points inside this spatial volume the sorption material ZEO can be made available, substantially fully dried and thus regenerated, for a subsequent drying process.

The through-flow cross-sectional area SDF of the sorption unit SE in the interior of the sorption container SB is embodied in the exemplary embodiment here to be greater than the average cross-sectional area of the inlet connecting piece ES on the end of the air-guiding channel LK or of the tubular connecting section VA. The through-flow cross-sectional area SDF of the sorption material is preferably embodied to be between 2 and 40 times, in particular between 4 and 30 times, preferably between 5 and 25 times greater than the average cross-sectional area of the inlet connecting piece ES of the air-guiding channel LK with which said connecting piece opens into the inlet opening EO of the sorption container SB.

Summing up in general terms, it can therefore be useful in particular to provide one or more flow-conditioning elements SK in the sorption container SB and/or in an inlet-end tube portion VA, ES of the air-guiding channel LK facing towards the sorption container SB on the inlet side, in particular downstream of at least one fan unit LT inserted into the air-guiding channel LK, with one or more air passages SL such that equalization of the local flow cross-sectional profile of the air flow LS2 is effected when flowing through the sorption container SB in the through-flow direction DSR thereof, said through-flow direction being oriented from bottom to top, especially substantially vertically. Viewed in the through-flow direction DSR of the sorption container SB, at least one flow-conditioning element SK is provided in the lower cavity UH thereof at a vertical distance upstream of the heating device HZ. In the exemplary embodiment here, a slotted sheet or perforated sheet is provided as the flow-conditioning element. The slots SL in the slotted sheet SK substantially follow the course of the winding of a coiled-tube heater HZ which is positioned as a heating device at a clearance distance above the slots SL in the slotted sheet. The slotted sheet is arranged substantially parallel to and at a clearance distance from the air inlet cross-sectional area SDF of the sorption unit SE of the sorption container SB. Air passages, in particular slots SL, in the flow-conditioning element SK are preferably embodied so as to be larger at those locations at which the air flow LS1 entering the sorption container SB after its redirection in the through-flow direction DSR of the sorption container SB has a lower velocity, than at those locations at which the air flow LS1 entering the sorption container SB after its redirection in the through-flow direction DSR of the sorption container SB has a greater velocity, in order to obtain an equalization of the air flow flowing around the coiled heater HZ.

View in general terms, the sorption drying system exhibits the following specific flow conditions in the region of the sorption container SB: The air-guiding channel is coupled to the sorption container SB such that the incoming air flow LS1 opens into the sorption container SB with a, here substantially horizontal, direction of inflow and passes into a through-flow direction, here substantially vertical, which is different therefrom, with which it flows through the interior of the sorption container SB. The outflow direction of the air flow exiting the sorption container preferably corresponds substantially to the approximately vertical through-flow direction. The inlet-side tube portion of the air-guiding channel opens into the sorption container such that its inflow direction is diverted into the forced through-flow direction of the sorption container SB, in particular by between 45° and 135°, preferably by approximately 90° from its here approximately horizontal inflow direction. Viewed in the direction of flow, upstream of the sorption container SB at least one fan unit is inserted into the inlet-end tube portion of the air-guiding channel for generating a forced air flow in the direction of at least one inlet opening of the sorption container SB. The fan unit LT is arranged in the base module underneath the washing container SPB.

The sorption container is embodied with a geometrical shape such that its sorption unit with the sorption material has air forced through it substantially in or against the direction of gravity, which is guided via the air guiding channel from the washing container SPB into the sorption container SB. The sorption unit of the sorption container SB can preferably comprise at least one substantially horizontally arranged lower sieve element or grid element and at least one substantially horizontally arranged upper sieve element or grid element at a predefinable vertical distance from one another, the spatial volume between the two sieve elements or grid elements being largely completely filled with the sorption material. The inlet cross-sectional area and the discharge cross-sectional area of the sorption unit of the sorption container SB are chosen so as to be in particular substantially equal in size. The inlet cross-sectional area and the discharge cross-sectional area of the sorption unit of the sorption container SB are furthermore usefully arranged substantially congruently in relation to one another. The sorption container comprises, viewed in its through-flow direction, at least one layering comprising a lower cavity and a sorption unit arranged thereabove, arranged downstream in the through-flow direction. It has in its lower cavity at least one heating device. The sorption container SB comprises above its sorption unit at least one upper cavity for collecting outflowing air. The sorption material fills a fill volume in the sorption unit of the sorption container SB such that a flow inlet cross-sectional area arranged substantially perpendicular to the through-flow direction and a flow discharge cross-sectional area arranged largely parallel thereto is formed. The sorption container SB has in its upper cover part at least one outflow opening which is connected with the aid of at least one outflow component via a through-opening in the base of the washing container SPB to the interior thereof.

The sorption container SB can also especially be embodied as a substantially vertically-arranged tube, especially as a substantially vertically arranged cylinder, or as a sleeve aligned vertically on an edge. In this way a sorption column aligned vertically on an edge with a heating device and a downstream sorption unit can especially be provided for which the sorption material has an air through-flow direction against the direction of gravity prespecified for it. This advantageously makes possible a relatively compact embodiment variant for the sorption container which only takes up relatively little space.

The sorption material is advantageously embedded in the sorption container SB in the shape of the sorption unit such that a substantially equal air volume flow value can be applied to substantially each entry point to the through-passage cross-sectional area of the sorption unit. An aluminum- and/or silicon-oxide-containing, reversibly dehydratable, material, silica gel and/or zeolite, in particular type A, X, Y zeolite, is preferably provided, either singly or in any combination, as the sorption material. The sorption material is provided in the sorption container SB usefully in the form of a granular solid or granulate comprising a multiplicity of particles having a grain size substantially between 1 and 6 mm, in particular between 2.4 and 4.8 mm, as a fill, the fill height H of the particles corresponding to at least 5 times their grain size. The sorption material present as a granular solid or granulate is usefully present in the sorption container with a fill height H in the direction of gravity which corresponds to substantially 5 to 40 times, in particular 10 to 15 times the particle size of the granular solid or granulate. The fill height H of the sorption material is preferably chosen so as to be substantially between 1.5 and 25 cm, in particular between 2 and 8 cm, preferably between 4 and 6 cm. The granular solid or granulate can preferably be composed of a multiplicity of substantially spherical particles. The sorption material ZEO embodied as a granular solid or granulate advantageously usefully has an average fill density of at least 500 kg/m$^3$, in particular substantially between 500 and 800 kg/m$^3$, in particular between 600 and 700 kg/m$^3$, in particular between 630 and 650 kg/m$^3$, in particular preferably of approximately 640 kg/m$^3$.

In the sorption container SB, the reversibly dehydratable sorption material for absorbing a quantity of moisture transported in the air flow is usefully provided in a quantity by weight such that the quantity of moisture absorbed by the sorption material is lower than a quantity of moisture applied to the items to be washed, in particular a quantity of moisture applied in the rinsing step.

It can in particular be useful if in the sorption container SB the reversibly dehydratable sorption material is provided in a quantity by weight such that this is sufficient to absorb a quantity of moisture which corresponds substantially to a wetting quantity with which the items to be washed are wetted after the end of a final rinse step. The absorbed quantity of water corresponds preferably to between 4 and 25%, in particular between 5 and 15%, of the quantity of liquid applied to the items to be washed.

The sorption container SB usefully accommodates an amount by weight of sorption material ZEO of substantially between 0.2 and 5 kg, in particular between 0.3 and 3 kg, preferably between 0.2 and 2.5 kg.

The sorption material has in particular pores preferably of substantially between 1 and 12 Angstroms, in particular between 2 and 10, preferably between 3 and 8 Angstroms, in size.

It usefully has a water absorption capacity of substantially between 15 and 40 percent, preferably between 20 and 30 percent of its dry weight.

In particular, a sorption material is provided which can be desorbed at a temperature substantially in the range between 80° and 450° C., in particular between 220° C. and 250° C.

The air-guiding channel, the sorption container, and/or one or more additional flow-influencing elements are usefully embodied such that an air flow can be effected through the sorption material for the sorption and/or desorption thereof with a volume flow of substantially between 2 and 15 l/sec, in particular between 4 and 7 l/sec.

It can in particular be useful if at least one heating device is assigned to the sorption material, by means of which heating device an equivalent heat output of between 250 and 2500 W, in particular between 1000 and 1800 W, preferably between 1200 and 1500 W can be provided for heating the sorption material for the desorption thereof.

The ratio of heat output of at least one heating device which is assigned to the sorption material for the desorption thereof and air volume flow of the air flow which flows through the sorption material is preferably chosen so as to be between 100 and 1250 W sec/l, in particular between 100 and 450 W sec/l, preferably between 200 and 230 W sec/l.

In the sorption container SB, a through-flow cross-sectional area for the sorption material of substantially between 80 and 800 cm$^2$, in particular between 150 and 500 cm$^2$, is preferably provided.

The fill height of the sorption material over the inlet cross-sectional area SDF of the sorption container SB is usefully substantially constant.

It is in particular useful to embody the sorption material in the sorption container SB so as to absorb a quantity of water of substantially between 150 and 400 ml, in particular between 200 and 300 ml.

Furthermore, for at least one component of the sorption drying system TS at least one thermal overheating-protection device is provided. The component can preferably be formed by a component of the sorption container SB. In such cases this thermal overheating-protection device can be affixed to the outside of the sorption container SB. At least one electrical temperature protection unit TSI is provided as a thermal overheating-protection device (see FIGS. 4, 6, 8, 9). It is assigned in the exemplary embodiment here to the heating device HZ which is accommodated in the sorption container SB.

The electrical temperature-protection unit TSI is provided in the exemplary embodiment of FIGS. 4, 6, 8 and 9 in an outside recess EBU on the inner housing IG of the sorption container SB in the region of the vertical position of the heating device HZ. It comprises at least one electrical thermal switch TSA and/or at least one fuse SSI (see FIG. 17). The electrical thermal switch TSA and/or the fuse SSI of the electrical temperature-protection unit TSI are respectively inserted, preferably in series, into at least one electrical power supply line UB1, UB2 of the heating device HZ (see FIG. 8).

It can furthermore be useful to provide at least one control device HE, ZE (see FIG. 16) with a supervision logic, which in the event of a fault especially interrupts the power supply to the heating device HZ. The exceeding of an upper temperature limit, for example, constitutes a fault case, e.g. at the sorption container SB or the washing container.

Furthermore, the largely freely-hanging suspension of the sorption container, particularly underneath the base BO of the washing container SPB, can also serve as a thermal overheating-protection measure.

The thermal overheating-protection measure can furthermore comprise a positioning of the sorption container SB such that the sorption container has a predefined minimal gap distance LSP in relation to neighboring components and/or parts of a base module BG.

As a thermal overheating-protection device, there can be provided in addition to, or independently of, the measures indicated above, at least in the region of the sorption unit SE of the sorption container SB at least one outer housing AG in addition to the inner housing IG of the sorption container SB. Between the inner housing IG and the outer housing AG, an air gap clearance LS is present as a thermal insulation layer. Expressed in general terms the housing of the sorption container SB can thus be embodied around the region of the sorption unit with the sorption material on the outer side and/or inner side multiwall, especially double-walled. In addition to or independently of this, the sorption unit can be surrounded by at least one additional thermal insulation element inside the sorption container SB and/or outside the sorption container SB at least in the area of the sorption unit.

Figure 17:
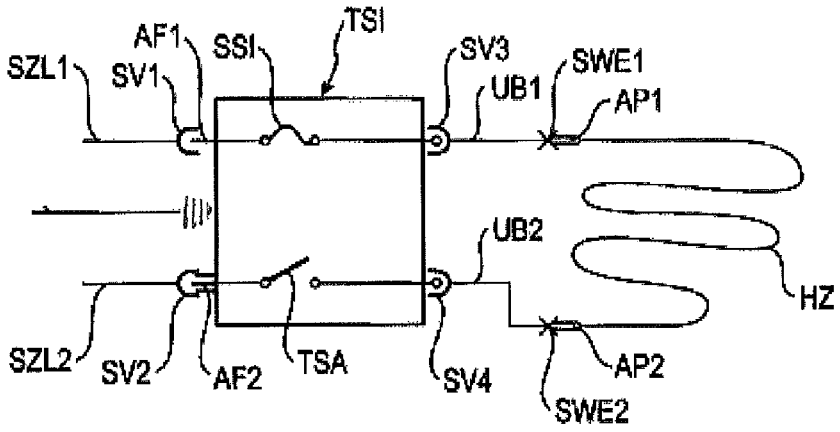
FIG. 17 shows in schematic representation the thermoelectric heat protection of the sorption container of FIGS. 4 to 10 of the sorption drying system of FIGS. 1 to 3, 11.

The heating device, here especially the coiled-tube heater HZ of FIGS. 4, 7, 8, 9, comprises two terminal poles AP1, AP2 which are routed outwards through corresponding through-openings in the housing of the washing container SPB. Each terminal pole or terminal pin AP1, AP2 is preferably switched in series with an overheating-protection element. The overheating-protection elements are grouped in the temperature protection unit TSI which is arranged externally on the housing of the sorption container SB in the vicinity of the two pole pins AP1, AP2. FIG. 17 shows the overheating-protection circuit for the coiled-tube heater HZ from FIG. 8. The first bypass line UB1 is attached to the first rigid pole pin AP1 by means of a welded connection SWE1. In an analogous manner, the second bypass line UB2 is attached to the second rigid pole pin AP2 by means of a welded connection SWE2. By means of a plug-in connection SV4, the bypass line UB2 is electrically contacted to the thermal switch TSA. The bypass line UB1 is electrically connected via a plug-in contact SV3 to the thermoelectric fuse SSI. At the input end, a first power supply line SZL1 is connected via a plug-in connection SV1 to the outwardly guided terminal lug AF1 of the fuse element SSI. In an analogous manner, a second power supply line SZL2 is connected via a plug-in connection SV2 to the outwardly guided terminal lug AF2 of the thermal switch element TSA. The second power supply line SZL2 can, in particular, form a neutral conductor, while the first power supply line SZL1 can be a "live phase". The thermal switch TSA opens as soon as a first upper limit for the temperature of the coiled-tube heater HZ is exceeded. As soon as the temperature falls below this limit again, it closes again so that the coiled-tube heater HZ is heated up once again. If, however, a critical upper temperature limit, which lies above the first upper limit, for the coiled-tube heater is reached, then the fuse SSI melts through and the electric circuit for the coiled-tube heater HZ is permanently interrupted. The two temperature-protection elements of the temperature-protection device TSI are in largely intimate heat-conducting contact with the inner housing IG of the sorption container. They can be separately detached from one another if certain upper temperature limits specifically assigned to them are exceeded.

Figure 14:
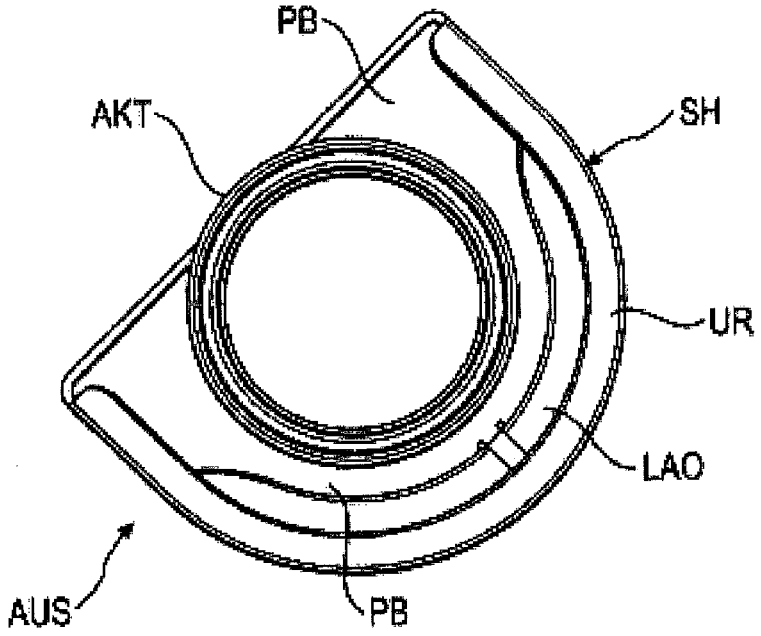

In accordance with FIGS. 10, 13, 14, the outflow connecting piece AKT which is connected to the outlet opening AO in the socket SO of the sorption container SB passes through the through-opening DG in the base BO preferably in a corner region EBR of the washing container SPB which lies outside the area of rotation swept over by the spray arm SA. This is illustrated in FIG. 2. Expressed in general terms, the outflow connecting piece AKT thus projects out of the base BO into the interior of the washing container SPB at a point which lies outside the area of rotation covered by the lower spray arm SA. The exhaust chimney connecting piece or the outflow connecting piece AKT is overlapped or covered over along its upper end portion by a spray-protection hood SH. The spray-protection hood SH covers over the outflow connecting piece AKT in an umbrella-like or mushroom-like manner. This spray-protection hood is, viewed from above (see FIG. 12), completely closed on the top-side and the side wall side; it is also, in particular, also completely closed on its underside in a region facing the spray arm SA. The outlet facility or the outlet element AUS is constructed such that it is possible, via its exhaust chimney connecting piece AKT, to be able to blow out as much air as possible from the sorption container SB into the interior of the washing container during the respective sorption or desorption and simultaneously provide a cover permeable to exhausted air through its spray-protection hood SH such that the penetration of washing liquor from the washing container into the interior of the sorption container SB is largely avoided. It exhibits in the exemplary embodiment here in a first approximation the geometric shape of a semi-circular cylinder. The spray-protection hood SH is represented schematically, viewed from above, in FIG. 12. On its top side, it has in the transition zones GF, URA between its largely planar top side and its substantially vertically downwardly projecting side walls (viewed from inside to outside) convexly curved flattening portions GF (see FIG. 13). If a spray jet, e.g. from the spray arm SA, strikes these transition zones GF, URA which are flattened out on the top edge or curved, then this spray jet pours like a film largely over the full surface of the spray-protection hood SA and cools this hood during the desorption process. This avoids undesired damage or stressing to the materials of components in the interior of the washing container because of excess heat.

The spray-protection hood SH is arranged at a free vertical distance opposite the outlet connecting piece AKT, forming a free space or cavity. In order to prevent liquid during spraying with the lower spray arm SA from being able to pass through the discharge opening of the outflow connecting piece AKT into the sorption container SB, a lower edge zone UR of the semi-circular-cylinder-portion-like side wall of the spray-protection hood SH is curved, arched or bent inwardly toward the outflow connecting piece AKT. This can readily be seen in FIG. 13. In addition, in the region of the top edge of the outflow connecting piece AKT, an encircling, radially outwardly projecting spray-water deflecting element or shielding element PB, in particular a baffle plate, is provided. This shielding element projects radially outwardly into the intermediate space or gap space between the cylindrical outflow connecting piece AKT and the inner wall of the spray-protection hood SH. Between the outer peripheral edge of this shielding element PB and the inner wall of the spray-protection hood SH there remains a free through-opening for the air flow LS2 which flows out from the outflow connecting piece AKT in the direction of the cover of the spray-protection hood SH and in doing so is diverted downwardly to the lower edge UR of the spray-protection hood SH, in particular by approximately 180°. The deflection path is labeled ALS in FIG. 13. The outwardly projecting shielding element PB is supported in the exemplary embodiment of FIG. 13 at individual circumferential points of its outer edge by means of web elements SET against the inner wall of the side wall of the spray-protection hood SH which encircles in the form of a ring segment portion.

FIG. 14 shows the spray-protection hood SH, viewed from below, together with the outflow connecting piece AKT. The shielding element PB shields the discharge opening of the outflow connecting piece AKT as a laterally or sideways-projecting edge or web in a substantially circumferential manner. In particular, the shielding element PB closes off the underside of the spray-protection hood SH in the region of the rectilinear side wall facing the spray arm SA. Only in the semi-circularly bent portion of the spray-protection hood SH facing away from the spray arm between the shielding element PB and the externally concentrically arranged side wall of the spray-protection hood SH running in a radially offset manner is a gap clearance LAO cleared through which the air can flow out from the outflow connecting piece AKT into the interior of the washing container SPB. In the exemplary embodiment here from FIG. 14, the gap clearance LAO is substantially embodied in a sickle-like manner. The air flow LS2 is forced thereby onto the diverted path ALS which diverts it from its vertically upwardly oriented outflow direction downward where it can exit only through the sickle-shaped gap clearance LAO in the shape of a segment of a divided circle in the lower region of the spray-protection hood SH. The outflow connecting piece AKT usefully projects to a height HO relative to the base BO such that its top edge lies higher than the level of a set total wash-tank volume or foam volume envisaged for a wash cycle.

The outflow element AUS which is affixed at the outlet end of the sorption container SB and projects into the interior of the washing container SPB is therefore usefully embodied such that the air flow LS2 exiting from it is directed away from the spray arm SA. In particular, the outflowing air flow LS2 is guided into a rear or back corner region between the back wall RW and the adjacent side wall SW of the washing container. This largely prevents spray-water or foam from being able to pass through the opening of the outflow connecting piece into the interior of the sorption container during the cleaning cycle or any other wash cycle. The desorption process could otherwise be impaired or completely nullified in this way. In addition, sorption material could be permanently damaged by washing solution. This is because extensive tests have shown that the functionality of the sorption material in the sorption container can be largely retained or preserved over the life time of the dishwasher if water, detergent and/or rinse aid in the washing solution is reliably prevented from reaching the sorption material.

In summary, at least one outflow device AUS which is connected to at least one outflow opening AO of the sorption container SB is arranged in the interior of the washing container SPB such that air LS2 blown out from it is largely directed away from at least one spray device SA accommodated in the washing container SPB. The outflow device AUS is arranged outside the working area of the spray device SA. The spray device can be e.g. a rotating spray arm SA. The outflow device AUS is preferably provided in a rear corner region EBR between the back wall RW and an adjacent side wall SW of the washing container SPB. The outflow device AUS has in particular an exhaust opening ABO at a vertical distance HO above the base BO of the washing container SPB, said exhaust opening lying higher than the level of a set total wash-tank volume envisaged for a wash cycle. The outflow device AUS comprises an outflow connecting piece AKT and a spray-protection hood SH. The spray-protection hood SH has a geometric shape which slips over the exhaust opening ABO of the outflow connecting piece AKT. The spray-protection hood SH is slipped over the outflow connecting piece AKT such that air flowing up through the outflow connecting piece AKT out of the sorption container SB with a rising direction of flow can, after its exit from the exhaust opening ABO of the outflow connecting piece AKT, have a downwardly directing forced flow path ALS impressed upon it. The upwardly projecting outflow connecting piece AKT above the base BO of the washing container SPB is coupled to the terminal connecting piece STE on the cover part DEL of the sorption container SB arranged under the base BO. The spray-protection hood SH is, in its housing region GF facing the spray device SA, embodied in a closed manner both on the top and on the underside. The spray-protection hood SH overlaps the exhaust opening ABO of the outflow connecting piece AKT with an upper free space. The outflow connecting piece AKT has an upper, outwardly arched edge or circumferential collar KR. The spray-protection hood SH envelops an upper end portion of the outflow connecting piece AKT so as to form a gap clearance SPF between its inner wall and the outer wall of the outflow connecting piece AKT. The gap clearance SPF between the spray-protection hood SH and the outflow connecting piece AKT is embodied such that an air outflow path ALS out of the outflow connecting piece AKT is provided which is directed away from the spray device SA in the washing container SB. A spray-water deflecting element PB projecting into the gap clearance SPF is provided on the outflow-connecting piece AKT. A lower edge zone UR of the spray-protection hood SH is arched inwardly. The spray-protection hood SH has a rounded outer surface such that it causes a spray jet from the spray device SA which strikes it to pour over its surface like a film. This serves to cool the outflow device.

If necessary it can also be useful to provide a number of such outflow devices of the sorption drying system in the washing container SB.

Figure 15:
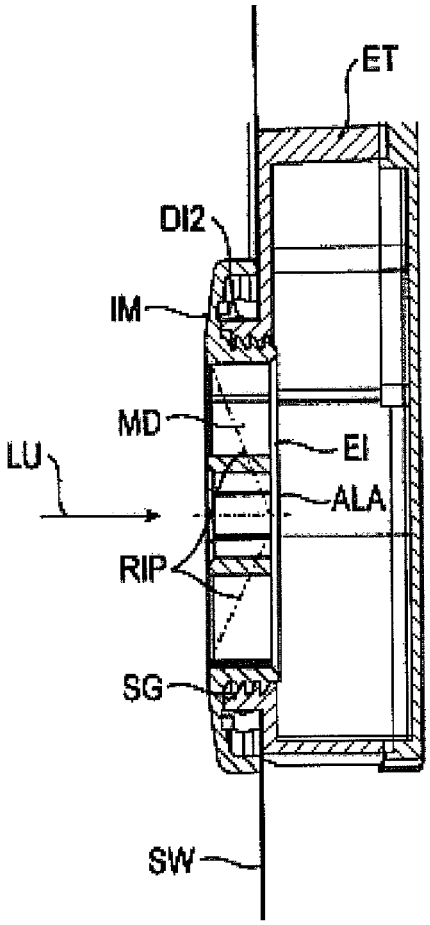
FIG. 15 shows in schematic sectional representation, viewed from the side, the inlet element of the sorption drying system of FIGS. 1 to 3 as an individual item.

FIG. 15 shows a schematic longitudinal sectional representation of the fixing of the inlet-side, end face portion ET of the air-guiding channel LK in the region of the outlet opening ALA in the side wall SW of the washing container SPB of FIG. 2. The end face portion ET of the air-guiding channel LK projects into the interior of the washing container SPB such that a collar edge is formed circumferentially projecting perpendicularly in relation to the side wall SW. This collar edge has an internal thread SH. An annular inlet element IM with an external thread is screwed into this internal thread SG. It therefore functions as a fixing element for holding the end portion ET. This annular fixing element has a toroidal encircling receiving chamber for a sealing element DI2. This sealing element DI2 seals an annular gap between the outer edge of the inlet-side frontal end portion ET of the air-guiding channel LK and the fixing element. The fixing element in the exemplary embodiment here is formed in particular by a screw-cap-like threaded ring which is screwed to the inlet-side end face portion ET of the air-guiding channel LK. In the exemplary embodiment, the annular fixing element IM has a central through passage MD through which air LU can be sucked out of the interior of the washing container SPB into the air guiding channel.

If necessary it can also be useful to provide in or in front of the inlet opening MD of the inlet-side tube portion ET of the air-guiding channel LK at least one ribbed engagement protection which has between its engagement ribs RIP freely passable gaps for the inflow of air LU out of the washing container. These ribs RIP are indicated in FIG. 15 by dashed and dotted lines. These ribs can also serve as a screw-in aid for screwing the air inlet element IM into the internal thread of the end portion of the air-guiding channel.

Considered in general terms it can also be useful if necessary to provide a sorption drying system having a number of sorption units or sorption columns respectively with the associated heating devices in a common sorption container SB or in a number of separate sorption containers SB. These sorption columns or their sorption containers SB can be connected to one another both in serious and also as parallel arms of the sorption drying system. This number of sorption columns arranged serially or in parallel can usefully be connected far one or more air-guiding channels to one or more outlet openings of the washing container for sucking air out of the washing container and/or with outflow openings of one or more outflow devices for blowing air into the washing container.

Figure 16:
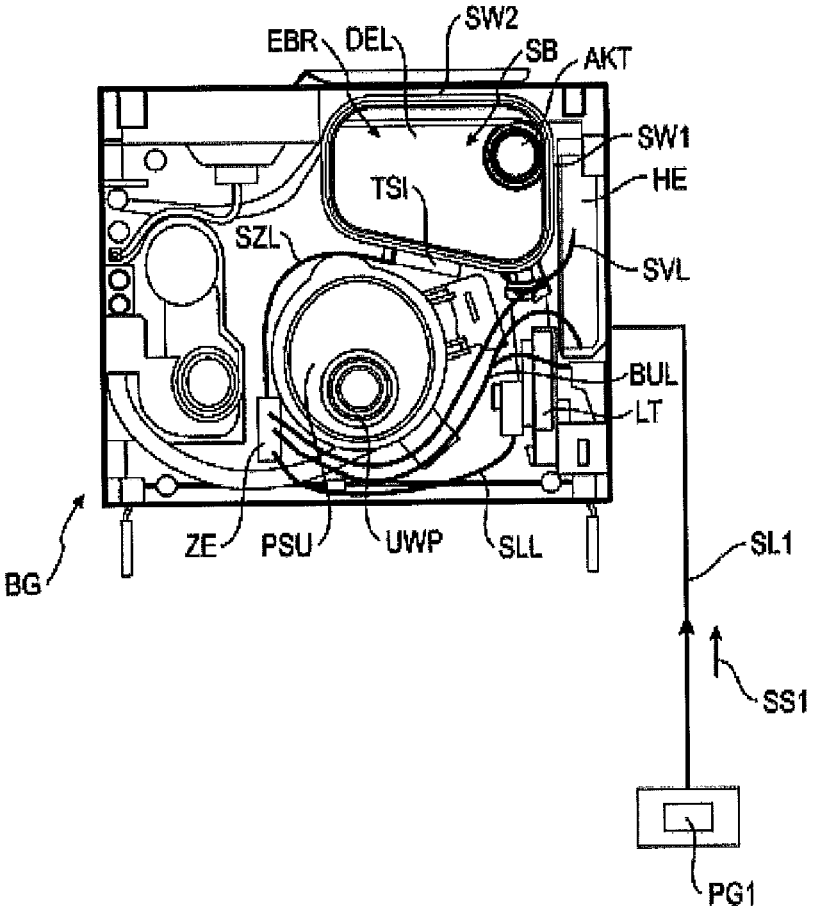
FIG. 16 shows in schematic plan representation, viewed from above, the base module of the dishwasher from FIG. 1 and FIG. 2.

FIG. 16 shows in schematic plan view representation the base module BG. It comprises in addition to the fan unit LT, the sorption container SB, the circulating pump UWP, etc. a main control device HE for the control and monitoring thereof. The heating device HZ of the sorption container SB is also regulated for the desorption process thereof by means of at least one control device. This control device is formed in the exemplary embodiment here by an additional control device ZE. It serves to interrupt or switch through the power supply line SZL to the heating device HZ as required. The additional control device ZE is controlled from the main control device HE via a bus line BUL. A power supply line SVL runs from the main control device HE to the additional control device ZE. This additional control device also controls the fan unit LT via a control line SLL. The power supply line to the fan unit LT can in particular also be integrated into the control line SLL.

Also connected to the main control device HE via a signal line is at least one temperature sensor TDE (see FIG. 2) which delivers corresponding measurement signals for the temperature in the interior of the washing container to the main control device. The temperature sensor TSE is suspended between stiffening ribs VR (see FIG. 3) in the intermediate space between the two arms AU, AB of the inlet-end tube portion RA1 of the air-guiding channel LK. It is thereby brought into contact with the side wall SW of the washing container SPB.

As soon as a cleaning cycle is now started, the main control device HE simultaneously switches on the additional control device ZE via the bus line BUL such that an electrical voltage is applied via the power supply line SZL to the pole pins AP1, AP2 of the heating device HZ if a desorption process is desired. As soon as a certain predetermined critical upper temperature limit has been reached during the desorption process in the interior of the washing container SPB, which the main control device HE can determine for example via the measurement signals of the temperature sensor, it can give the instruction to the additional control device ZE via the bus line BUL to remove the voltage on the power supply line SZL and thereby to switch off the heating device HZ completely as well as simultaneously if necessary or offset by a prespecifiable interval, to switch of the fan unit HLT, i.e. the complete sorption drying device TV. In this way the desorption process for the sorption material in the sorption container can be terminated in a safe manner, if a fault, especially an overheating of the sorption container SB with desorption material for example, of the heating device assigned to it all of the interior of the washing container SB occurs during the desorption process. In a corresponding manner the main control device HE can also instruct the additional control device ZE in the event of any other fault to switch off the heating device. Such a fault can typically also be a failure wall and interruption of the communication link on the data bus BUL. If necessary the additional control device ZE can also switch off the heating device HZ and/or the fan unit LT autonomously, i.e. independently of the main control device HE if a fault occurs during the respective desorption process.

It can if necessary be useful to provide for a person operating the dishwasher GS the option of activating or deactivating the sorption drying system TS through activation or deactivation of a specially provided program button or through corresponding selection of a program menu. This is illustrated schematically in FIG. 16 in that included in the drawing is a program button or a program menu item PG1 which gives appropriate activation or deactivation signals for switching on and switching off the sorption drying system TE via a control line SL1 by means of control signals SS1 to the control logic HE.

Figure 18:
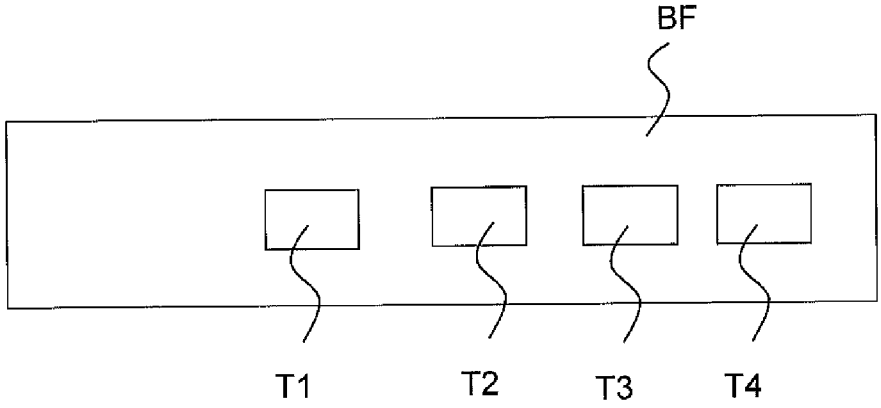
FIG. 18 shows a control panel of the household dishwasher.

In particular a first selection button T1 connected to the main control device for selecting an "Energy" or "Sorption operation" program variant can be provided in the control panel shown of the household dishwasher shown in FIG. 18. In this program, the emphasis is on saving energy. This is achieved in the case of the present exemplary embodiment in that, when the selection button T1 is actuated, the main control device HE controls the wash program such that, during the final rinse cycle or the rinsing step there is no heating at all by means of a continuous-flow heater. Furthermore the main control device HE controls the sorption drying system TS such that the drying of the washed items, in particular of the crockery, is effected during a drying step following on from the final rinse step solely with the aid of the sorption drying system TS.

In the case of the present exemplary embodiment the main control device HE is configured such that, in addition to or independently of the first "Energy" button T1, the main control device HE is connected to a further "Drying performance" button T2 of the control panel BF of the household dishwasher GS. As a result of actuating the second button T2, the main control device HE controls the sorption drying system ST such that the fan run time of the fan unit all of the blower LT of the sorption drying system ST is increased during the drying step. Improved drying of all items to be washed, especially the crockery items, can be achieved by this means.

In the case of the present exemplary embodiment there can also be provision, as an alternative or in addition to increasing the fan run time, of configuring the main control device HE such that on actuation of the second button T2, in addition to pure sorption drying, the interior of the washing container SB is heated up by means of a continuous-flow heater not described in any detail but generally known to the person skilled in the art however with heated rinsing liquid during the final rinse cycle or final rinse step. In such cases it can advantageously be sufficient for the transfer of heat to the items to be dried caused by the rinsing cycle to be undertaken with a lower energy use than in the case of sorption drying. This is because the sorption drying system now used allows electrical heating energy to be saved by sorption of moisture. Thus both by so-called "self heating drying" and also by sorption drying, i.e. by a combination of the two types of drying or by their complementing each other, an improved drying of wet or moist items to be dried can be achieved.

In addition to or independently of the previous specific buttons T1, T2, a third button "Program run time" T3 connected to the main control device HE can be provided. When the sorption drying system ST is switched on the program run time can be reduced compared to conventional drying systems (without sorption drying). On actuation of the third button T3 the main control device HE can if necessary, in addition to heating up the respective washing liquor by means of a desorption process, heat up the washing liquor by means of a continuous-flow heater not shown in any great detail but generally known to the person skilled in the art however, especially in the pump sump of the household dishwasher GS in the prewash phase and/or cleaning phase. In addition to or independently of this, controlled by the main control device HE, by increasing the spray pressure, e.g. by increasing the motor speed of the circulating pump UWP, the run time for cleaning (cleaning step) can be further reduced, furthermore the drying time can be further reduced by increasing the rinsing temperature.

In addition to or independently of the previous specific buttons T1, T2, T3, a fourth button T4 with the function "Influence the cleaning performance" can be provided. On actuation of this button T4 the main control device HE can control the household dishwasher GS such that the cleaning performance is enhanced over the same runtime without energy consumption being increased compared to a dishwasher without a sorption drying system TS.

This is because heat energy for heating a desired total quantity of liquid in the wash tank can be saved in that, during a prewash and/or cleaning cycle, the desorption process is started at the same time and hot air, laden with a quantity of water discharged by the sorption material, passes into the washing container SB as a result.

The invention claimed is:

1. A dishwasher, comprising:

a washing container;

a controller configured to control an operation of the dishwasher by means of a wash program;

a sorption drying system to dry items to be washed that are arranged inside the washing container;

input means connected to the controller, the input means to modify the wash program; and an air-guiding channel; wherein the sorption drying system has a sorption container with a heater and reversibly dehydratable sorption material, the sorption container being connected to the washing container by the air-guiding channel to generate an air flow, and wherein the air-guiding channel includes an inlet-side tube portion which opens into the sorption container such that an inflow direction of the air flow is steered into the sorption container in such a way that the air flow is diverted approximately 90 degrees from the inflow direction as the air flow enters the sorption container and prior to reaching the heater and the reversibly dehydratable sorption material, such that a direction of the air flow through the reversibly dehydratable sorption material is substantially against the direction of gravity.

2. The dishwasher of claim 1, wherein the dishwasher is a household dishwasher.

3. The dishwasher of claim 1, wherein the wash program has a plurality of individual program steps with at least one pre-wash step, at least one cleaning step, at least one intermediate wash step, at least one final rinse step, and at least one drying step; and wherein the individual program steps are executed consecutively one after the other.

4. The dishwasher of claim 3, wherein, as a result of actuating the input means, the controller executes the final rinse step entirely without heating up a rinsing agent that is used for the final rinse step.

5. The dishwasher of claim 3, wherein, as a result of actuating the input means, the controller executes the drying step exclusively by means of the sorption drying system.

6. The dishwasher of claim 3, wherein, as a result of actuating the input means, the controller increases the duration of the drying step.

7. The dishwasher as claimed in claim 6, wherein the sorption drying system has a fan, and wherein the controller increases the duration of the drying step by switching on the fan of the sorption drying system for an increased period of time.

8. The dishwasher of claim 4, wherein, as a result of actuating the input means, the controller controls the dishwasher such that the rinsing agent is heated up for the final rinse step.

9. The dishwasher of claim 8, further comprising a continuous-flow heater that is connected to the controller, wherein the controller controls the continuous-flow heater to heat up the rinsing agent.

10. The dishwasher of claim 3, wherein, as a result of actuating the input means, the controller controls the dishwasher such that at least one of a washing liquid used for the cleaning step is heated and a liquid used for the prewash step is heated.

11. The dishwasher of claim 10, further comprising a continuous-flow heater, which is connected to the controller and configured to heat up at least one of the washing liquid during the cleaning step and the liquid during the prewash step, and wherein the controller is configured to at least partly switch on the continuous-flow heater during at least one of the cleaning step and the prewash step.

12. The dishwasher of claim 3, wherein, as a result of actuating the input means, the controller controls the dishwasher such that during at least one of the cleaning step and the prewash step, a spray pressure, with which one of the cleaning liquid and the liquid is applied for the prewash step, is increased.

13. The dishwasher of claim 12, further comprising a circulation pump that is connected to the controller and a motor driving the circulating pump, wherein the controller operates the motor at a higher speed for the increased spray pressure.

14. The dishwasher of claim 3, wherein, as a result of actuating the input means, the controller simultaneously starts a desorption process of the sorption drying system during at least one of the prewash step and the cleaning step.

* * * * *